US012753541B2

(12) United States Patent
Baek et al.

(10) Patent No.: US 12,753,541 B2
(45) Date of Patent: Oct. 6, 2026

(54) CLOTHES TREATING APPARATUS

(71) Applicant: SAMSUNG ELECTRONICS CO., LTD., Suwon-si (KR)

(72) Inventors: Kwanwoo Baek, Suwon-si (KR); Zoohyeong Kim, Suwon-si (KR); Jongwon Park, Suwon-si (KR); Myungwoo Lee, Suwon-si (KR); Changwoo Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 19/037,751

(22) Filed: Jan. 27, 2025

(65) Prior Publication Data

US 2025/0230598 A1 Jul. 17, 2025

Related U.S. Application Data

(63) Continuation of application No. PCT/KR2025/000309, filed on Jan. 7, 2025.

(30) Foreign Application Priority Data

Jan. 11, 2024 (KR) ..... 10-2024-0005071

(51) Int. Cl.
*D06F 37/26* (2006.01)
*D06F 25/00* (2006.01)
(Continued)

(52) U.S. Cl.
CPC ..... *D06F 37/267* (2013.01); *D06F 25/00* (2013.01); *D06F 37/264* (2013.01); *D06F 58/02* (2013.01);
(Continued)

(58) Field of Classification Search
CPC ..... D06F 25/00; D06F 58/20; D06F 37/267; D06F 58/206; D06F 37/264; D06F 58/24; D06F 58/02
See application file for complete search history.

(56) References Cited

U.S. PATENT DOCUMENTS 8,191,388 B2 6/2012 Kim et al.
10,590,583 B2 3/2020 Kitayama
(Continued)

FOREIGN PATENT DOCUMENTS

CN 205258934 U 5/2016
CN 213086366 U 4/2021
(Continued)

OTHER PUBLICATIONS

International Search Report and the Written Opinion of the International Searching Authority dated Apr. 28, 2025 for International Application No. PCT/KR2025/000309.

*Primary Examiner* — Benjamin L Osterhout
(74) *Attorney, Agent, or Firm* — STAAS & HALSEY LLP

(57) ABSTRACT

A clothes treating apparatus may include: a tub including a tub back forming a rear side of the tub, the tub back having: a first region including a plurality of reinforcing ribs, and a second region including a duct mounting portion; a drum inside the tub and configured to accommodate laundry; a rotatable shaft connected to the drum and configured to rotate the drum; a bearing housing coupled to the tub and supporting the rotatable shaft; an exhaust duct on the tub back and including a duct body mounted on the duct mounting portion, coupled to the bearing housing, and including a material having a strength that is higher than a strength of the tub; and a drying device configured to remove moisture from air discharged from the tub through the
(Continued)

exhaust duct, heat the discharged air from which the moisture was removed, and supply the heated air back to the tub.

17 Claims, 15 Drawing Sheets

(51) Int. Cl.
*D06F 58/02* (2006.01)
*D06F 58/20* (2006.01)
*D06F 58/24* (2006.01)

(52) U.S. Cl.
CPC ..... *D06F 58/206* (2013.01); *D06F 58/24* (2013.01); *D06F 58/20* (2013.01)

(56) References Cited

U.S. PATENT DOCUMENTS

| | | | |
|---|---|---|---|
| 12,043,938 | B2 | 7/2024 | Yong et al. |
| 2017/0159230 | A1 | 6/2017 | Qian et al. |
| 2019/0024279 | A1 | 1/2019 | Lee |
| 2024/0167208 | A1 | 5/2024 | Kang et al. |

FOREIGN PATENT DOCUMENTS

| | | | | | |
|---|---|---|---|---|---|
| CN | 113106715 | A | | 7/2021 | |
| CN | 113355838 | A | * | 9/2021 | ..... D06F 25/00 |
| CN | 115679608 | A | | 2/2023 | |
| CN | 218436269 | U | | 2/2023 | |
| CN | 219603988 | U | | 8/2023 | |
| DE | 112006003872 | T5 | * | 3/2009 | ..... D06F 37/269 |
| EP | 1116812 | A1 | * | 7/2001 | ..... D06F 23/06 |
| EP | 1707662 | A2 | * | 10/2006 | ..... H02K 1/187 |
| EP | 2390400 | B1 | * | 6/2016 | ..... D06F 34/16 |
| JP | 2010012088 | A | * | 1/2010 | |
| JP | 6572192 | | | 9/2019 | |
| JP | 6904921 | | | 7/2021 | |
| KR | 10-2007-0083059 | | | 8/2007 | |
| KR | 10-1229200 | | | 2/2013 | |
| KR | 101453267 | B1 | * | 10/2014 | ..... D06F 23/02 |
| KR | 10-164430 | | | 8/2016 | |
| KR | 10-2019-0010178 | | | 1/2019 | |
| KR | 10-2369335 | | | 3/2022 | |
| KR | 20220114165 | A | * | 8/2022 | ..... D06F 58/08 |
| KR | 20220122240 | A | * | 9/2022 | ..... D06F 58/20 |
| KR | 10-2022-0135096 | | | 10/2022 | |
| KR | 10-2023-0057787 | | | 5/2023 | |
| KR | 20230057787 | A | * | 5/2023 | ..... D06F 58/02 |
| TW | I352763 | B | * | 11/2011 | ..... D06F 58/04 |
| WO | WO-2007132955 | A1 | * | 11/2007 | ..... D06F 37/264 |

* cited by examiner

CLOTHES TREATING APPARATUS

CROSS-REFERENCE TO RELATED APPLICATIONS

This is a continuation application, under 35 U.S.C. § 111(a), of International Application No. PCT/KR2025/000309, filed Jan. 7, 2025, which claims priority under 35 U.S.C. § 119 to Korean Patent Application No. 10-2024-0005071, filed Jan. 11, 2024, in the Korean Intellectual Property Office, the disclosures of which are incorporated herein in their entireties by reference.

DESCRIPTION

Technical Field

The present disclosure relates to a clothes treating apparatus including a drying device.

Background Art

A clothes treating apparatus is a device for treating and/or managing clothes. The clothes treating apparatus may include a washing machine and a clothes dryer.

The washing machine is a device that uses a driving force of a drive motor to agitate laundry, water, and detergent, which are put into a tub together, so as to wash the laundry through mutual friction.

Regardless of the type of the washing machine, processes performed by the washing machine may include a washing process in which detergent and water are supplied to the tub storing the laundry and the laundry is rotated while the drum is rotated, a rinsing process in which water is supplied to the tub and the drum is rotated to rinse the laundry, and a spin-drying process in which water is discharged from the tub and the drum is rotated to remove moisture from the laundry.

The processes performed by the washing machine may include a drying process in which the laundry is dried by blowing heated air generated from a drying device into a space containing the laundry. The washing machine may include the drying device to perform the drying process.

DISCLOSURE

Technical Problem

The present disclosure is directed to providing a clothes treating apparatus having improved internal space efficiency.

Further, the present disclosure is directed to providing a clothes treating apparatus including an improved structure capable of securing a space even when an exhaust duct is coupled.

Further, the present disclosure is directed to providing a clothes treating apparatus including an improved structure capable of reinforcing a strength of a tub.

Technical Solution

In accordance with the present disclosure a clothes treating apparatus may include: a tub including a tub back forming a rear side of the tub, the tub back having: a first region including a plurality of reinforcing ribs, and a second region including a duct mounting portion; a drum inside the tub and configured to accommodate laundry; a rotatable shaft connected to the drum and configured to rotate the drum; a bearing housing coupled to the tub and supporting the rotatable shaft; an exhaust duct on the tub back and including a duct body mounted on the duct mounting portion, coupled to the bearing housing, and including a material having a strength that is higher than a strength of the tub; and a drying device above the tub and configured to remove moisture from air discharged from the tub through the exhaust duct, heat the discharged air from which moisture was removed, and supply the heated air back to the tub.

The second region of the tub back may further include a plurality of ribs that have a lower protruding height than the plurality of reinforcing ribs.

The tub back may include a tub exhaust port in the duct mounting portion, and the duct body may include a duct exhaust port corresponding to the tub exhaust port to allow an inside of the tub and the exhaust duct to communicate with each other so that the air discharged from the tub through the exhaust duct flows through the tub exhaust port, then through the duct exhaust port, and then through the duct body.

The duct body may include a duct inserting portion protruding into tub exhaust port.

The duct inserting portion may protrude from the duct body along a circumference of the duct exhaust port.

The duct inserting portion may include a drainage groove extending along a protruding direction of the duct inserting portion to allow moisture to move to the inside of the tub.

The exhaust duct may further include a sealing member between the tub exhaust port and the duct inserting portion to prevent air discharged from the tub from flowing out between the tub exhaust port and the duct inserting portion.

The clothes treating apparatus may further include: a duct cover coupled to the duct body and the duct cover may include a material having a strength that is higher than the strength of the tub.

The clothes treating apparatus may further include: a duct cover coupled to the duct body, the duct body may include a body coupling hole, and the duct cover may include a cover coupling hole corresponding to the body coupling hole.

The duct body may be coupled to the tub.

The duct body may include a body coupling portion on a side of the duct body, and the duct cover and the bearing housing may be coupled with the body coupling portion interposed therebetween.

The bearing housing may include a housing protrusion that protrudes toward, and may be coupled to, the duct body.

The housing protrusion may be exposed to an outside of the tub, and the duct body may include a body coupling portion on a side of the duct body that may be coupled to the housing protrusion so as to couple the duct body and the bearing housing.

The clothes treating apparatus, may further include: a duct cover coupled to the duct body and that may include a cover coupling portion. The tub may include a tub protrusion protruding from the tub back toward the duct cover and that may correspond to the cover coupling portion, and the cover coupling portion may be coupled to the tub protrusion.

At least a portion of the duct mounting portion may be open so that the duct body may be exposed to an inside of the tub.

Another aspect of the present disclosure provides a clothes treating apparatus including: a tub including reinforcing ribs and a duct mounting portion, in which cut ribs having a lower protruding height than the reinforcing ribs are formed; a drum configured to be rotatable inside the tub; a bearing housing configured to support a rotating shaft provided to rotate the drum, the bearing housing coupled to the tub; a drying device including a heat pump and configured to dry air discharged from the drum and to supply heated air to the tub; and an exhaust duct configured to allow air discharged from the drum to flow into the drying device. The exhaust duct includes a duct body including a material having a higher strength than a strength of the tub to reinforce the strength of the mounting portion and provided to be mounted on the duct mounting portion; and a duct cover coupled to the duct body.

Another aspect of the present disclosure provides a clothes treating apparatus including: a tub including a tub back in which a reinforcing rib is formed in at least a portion thereof and a duct mounting portion is formed in other portion thereof; a drum configured to be rotatable inside the tub; a bearing housing coupled to the tub; a drying device including a heat pump and configured to supply heated air to the tub; and an exhaust duct configured to allow air discharged from the drum to flow into the drying device. The exhaust duct includes a duct body including a material having a higher strength than a strength of the tub to reinforce the strength of the duct mounting portion and provided to, in response to being mounted on the duct mounting portion, be coupled to the bearing housing; and a duct cover coupled to an open side of the duct body.

Advantageous Effects

MODES OF THE INVENTION

Figure 1:
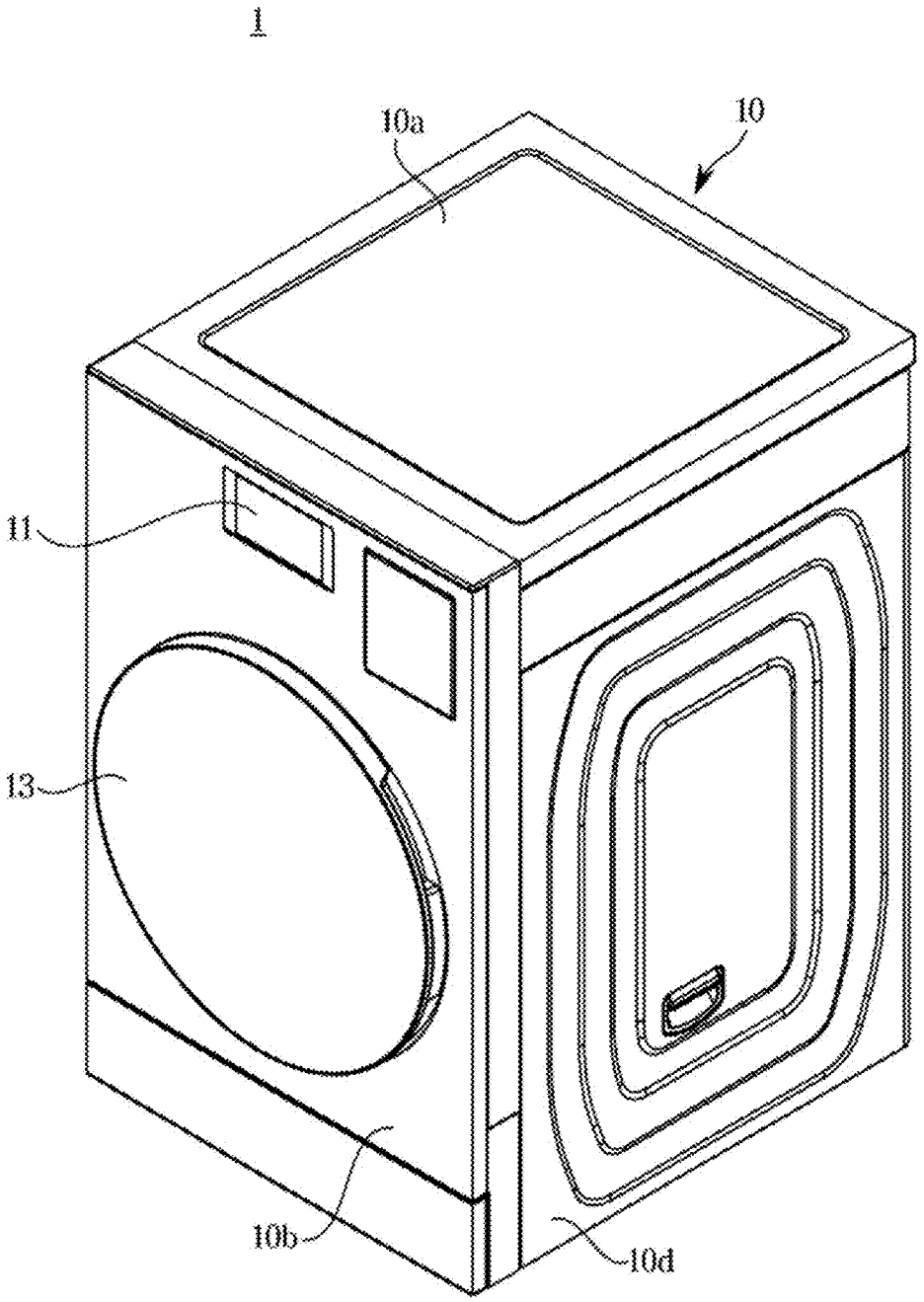
FIG. 1 is a perspective view of a clothes treating apparatus according to one embodiment of the present disclosure.

Various embodiments of the disclosure and terms used herein are not intended to limit the technical features described herein to specific embodiments, and should be understood to include various modifications, equivalents, or substitutions of the corresponding embodiments.

In describing of the drawings, similar reference numerals may be used for similar or related elements.

The singular form of a noun corresponding to an item may include one or more of the items unless clearly indicated otherwise in a related context.

In the disclosure, phrases, such as "A or B", "at least one of A and B", "at least one of A or B", "A, B or C", "at least one of A, B and C", and "at least one of A, B, or C" may include any one or all possible combinations of the items listed together in the corresponding phrase among the phrases.

As used herein, the term "and/or" includes any and all combinations of one or more of the associated listed items.

Terms such as "1st", "2nd", "primary", or "secondary" may be used simply to distinguish an element from other elements, without limiting the element in other aspects (e.g., importance or order).

When an element (e.g., a first element) is referred to as being "(functionally or communicatively) coupled" or "connected" to another element (e.g., a second element), the first element may be connected to the second element, directly (e.g., wired), wirelessly, or through a third element.

It will be understood that when the terms "includes", "comprises", "including", and/or "comprising" are used in the disclosure, they specify the presence of the specified features, figures, steps, operations, components, members, or combinations thereof, but do not preclude the presence or addition of one or more other features, figures, steps, operations, components, members, or combinations thereof.

When a given element is referred to as being "connected to", "coupled to", "supported by" or "in contact with" another element, it is to be understood that it may be directly or indirectly connected to, coupled to, supported by, or in contact with the other element. When a given element is indirectly connected to, coupled to, supported by, or in contact with another element, it is to be understood that it may be connected to, coupled to, supported by, or in contact with the other element through a third element.

It will also be understood that when an element is referred to as being "on" another element, it may be directly on the other element or intervening elements may also be present.

A washing machine according to various embodiments may perform washing, rinsing, spin-drying, and drying processes. The washing machine is an example of a clothes treating apparatus, and the clothes treating apparatus is a concept including a device capable of washing clothes (objects to be washed, and objects to be dried), a device capable of drying clothes, and a device capable of washing and drying clothes.

The washing machine according to various embodiments may include a top-loading washing machine in which a laundry inlet for inserting or removing laundry is provided to face upward, or a front-loading washing machine in which a laundry inlet is provided to face forward. The washing machine according to various embodiments may include a washing machine of a loading type other than the top-loading washing machine and the front-loading washing machine.

For the top-loading washing machine, laundry may be washed using water current generated by a rotating body such as a pulsator. For the front-loading washing machine, laundry may be washed by repeatedly lifting and lowering laundry by rotating a drum. The front-loading washing machine may include a dryer combined washing machine capable of drying laundry stored in a drum. The dryer combined washing machine may include a hot air supply device for supplying high-temperature air into the drum and a condensing device for removing moisture from air discharged from the drum. For example, the dryer combined washing machine may include a heat pump device. The washing machine according to various embodiments may include a washing machine using a washing method other than the above-described washing method.

The washing machine according to various embodiments may include a housing accommodating various components therein. The housing may be provided in the form of a box including a laundry inlet on one side thereof.

The washing machine may include a door for opening and closing the laundry inlet. The door may be rotatably mounted to the housing by a hinge. At least a portion of the door may be transparent or translucent to allow the inside of the housing to be visible.

The washing machine may include a tub disposed within the housing to store water. The tub may be formed in a substantially cylindrical shape with a tub opening formed on one side thereof. The tub may be disposed inside the housing in such a way that the tub opening corresponds to the laundry inlet.

The tub may be connected to the housing by a damper. The damper may absorb vibration generated when the drum rotates, and the damper may reduce vibration transmitted to the housing.

The washing machine may include a drum provided to accommodate laundry.

The drum may be disposed inside the tub such that a drum opening provided on one side of the drum corresponds to the laundry inlet and the tub opening. Laundry may pass sequentially through the laundry inlet, the tub opening, and the drum opening and then be received in the drum or removed from the drum.

The drum may perform each operation according to washing, rinsing, and/or spin-drying while rotating in the tub. A plurality of through holes may be formed in a cylindrical wall of the drum to allow water stored in the tub to be introduced into or to be discharged from the drum.

The washing machine may include a driving device configured to rotate the drum. The driving device may include a drive motor and a rotating shaft for transmitting a driving force generated by the drive motor to the drum. The rotating shaft may penetrate the tub to be connected to the drum.

The driving device may perform respective operations according to washing, rinsing, and/or spin-drying, or drying processes by rotating the drum in a forward or reverse direction.

The washing machine may include a water supply device configured to supply water to the tub. The water supply device may include a water supply pipe and a water supply valve disposed in the water supply pipe. The water supply pipe may be connected to an external water supply source. The water supply pipe may extend from an external water supply source to a detergent supply device and/or the tub. Water may be supplied to the tub through the detergent supply device. Alternatively, water may be supplied to the tub without passing through the detergent supply device.

The water supply valve may open or close the water supply pipe in response to an electrical signal from a controller. The water supply valve may allow or block the supply of water to the tub from an external water supply source. The water supply valve may include a solenoid valve configured to open or close in response to an electrical signal.

The washing machine may include the detergent supply device configured to supply detergent to the tub. The detergent supply device may include a manual detergent supply device that requires a user to enter detergent to be used for each washing, and an automatic detergent supply device that stores a large amount of detergent and automatically adds a predetermined amount of detergent during washing. The detergent supply device may include a detergent container for storing detergent. The detergent supply device may be configured to supply detergent into the tub during a water supply process. Water supplied through the water supply pipe may be mixed with detergent via the detergent supply device. Water mixed with detergent may be supplied into the tub. Detergent is used as a term including detergent for pre-washing, detergent for main washing, fabric softener, bleach, etc., and the detergent container may be partitioned into a storage region for the pre-washing detergent, a storage region for the main washing detergent, a storage region for the fabric softener, and a storage region for the bleach.

The washing machine may include a drainage device configured to discharge water contained in the tub to the outside. The drainage device may include a drain pipe extending from a bottom of the tub to the outside of the housing, a drain valve disposed on the drain pipe to open or close the drain pipe, and a pump disposed on the drain pipe. The pump may pump water from the drain pipe to the outside of the housing.

The washing machine may include a control panel disposed on one side of the housing. The control panel may provide a user interface for interaction between a user and the washing machine. The user interface may include at least one input interface and at least one output interface.

The at least one input interface may convert sensory information received from a user into an electrical signal.

The at least one input interface may include a power button, an operation button, a course selection dial (or a course selection button), and a washing/rinsing/spin-drying setting button. The at least one input interface may include a tact switch, a push switch, a slide switch, a toggle switch, a micro switch, a touch switch, a touch pad, a touch screen, a jog dial, and/or a microphone.

The at least one output interface may visually or audibly transmit information related to the operation of the washing machine to a user.

For example, the at least one output interface may transmit information related to a washing course, operation time of the washing machine, and washing/rinsing/spin-drying settings to the user. Information about the operation of the washing machine may be output via a screen, an indicator, or a voice. The at least one output interface may include a liquid crystal display (LCD) panel, a light emitting diode (LED) panel, or a speaker.

The washing machine may include a communication module for wired and/or wireless communication with an external device.

The communication module may include at least one of a short-range wireless communication module and a long-range wireless communication module.

The communication module may transmit data to an external device (e.g., a server, a user device, and/or a home appliance) or receive data from the external device. For example, the communication module may establish communication with a server and/or a user device and/or a home appliance, and transmit and receive various types of data.

For the communication, the communication module may establish a direct (e.g., wired) communication channel or a wireless communication channel between the external devices, and support the performance of the communication through the established communication channel. According to an embodiment, the communication module may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or wide area network WAN)). These various types of communication modules may be integrated as a single component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an IrDA communication module, a Wi-Fi Direct (WFD) communication module, an ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, and a server in a mobile communication network.

According to an embodiment, the communication module may communicate with an external device such as a server, a user device and other home appliances through an access point (AP). The AP may connect a LAN, to which a washing machine or a user device is connected, to a WAN to which a server is connected. The washing machine or the user device may be connected to the server via the WAN. The controller may control various components of the washing machine (e.g., the drive motor, and the water supply valve). The controller may control various components of the washing machine to perform at least one operation including water supply, washing, rinsing, and/or spin-drying according to a user input. For example, the controller may control the drive motor to adjust the rotational speed of the drum or control the water supply valve of the water supply device to supply water to the tub.

The controller may include hardware such as a CPU or memory, and software such as a control program. For example, the controller may include at least one memory for storing an algorithm and program-type data for controlling the operation of components in the washing machine, and at least one processor configured to perform the above-mentioned operation by using the data stored in the at least one memory. The memory and the processor may each be implemented as separate chips. The processor may include one or more processor chips or may include one or more processing cores. The memory may include one or more memory chips or one or more memory blocks. Alternatively, the memory and the processor may be implemented as a single chip.

Hereinafter exemplary embodiments of a clothes treating apparatus will be described in detail with reference to the accompanying drawings. Hereinafter a washing machine is described for example of a clothes treating apparatus, but the present disclosure is not limited to the washing machine and may be applied to various devices for treating and/or managing clothes.

Figure 2:
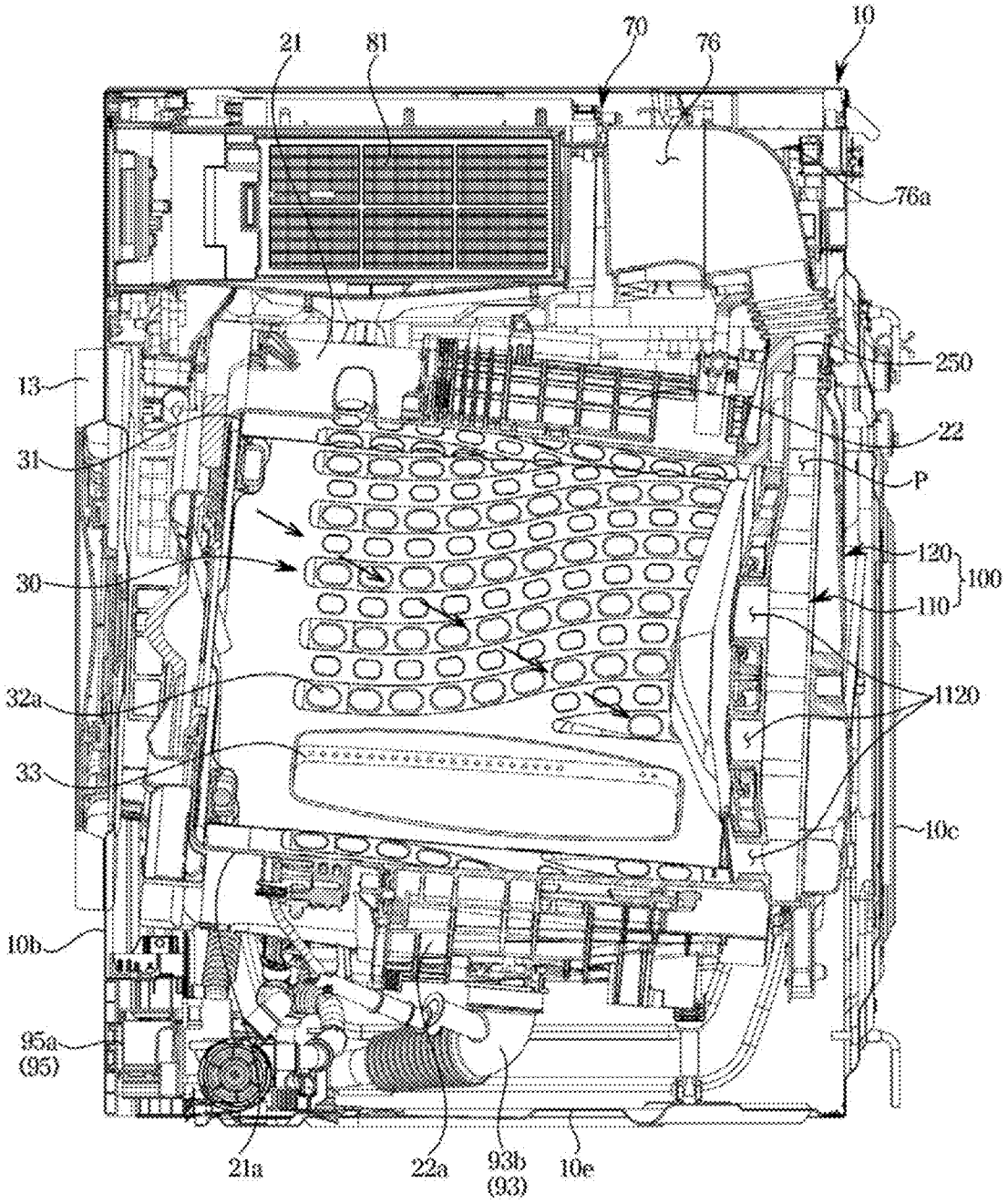
FIG. 2 illustrates a cross-section of the clothes treating apparatus according to one embodiment of the present disclosure.
Figure 3:
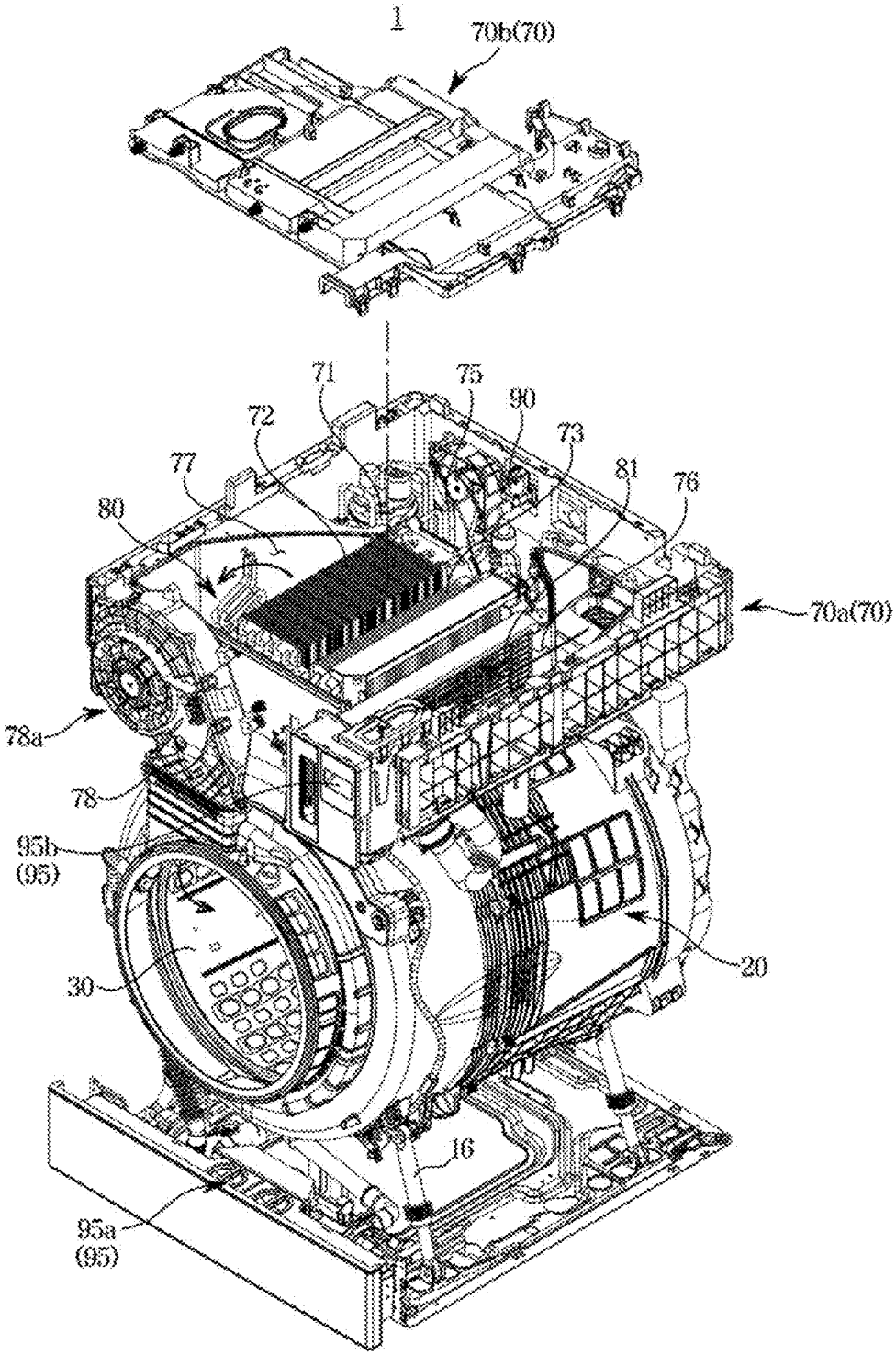
FIG. 3 illustrates a portion of a configuration disposed inside the clothes treating apparatus according to one embodiment of the present disclosure.
Figure 4:
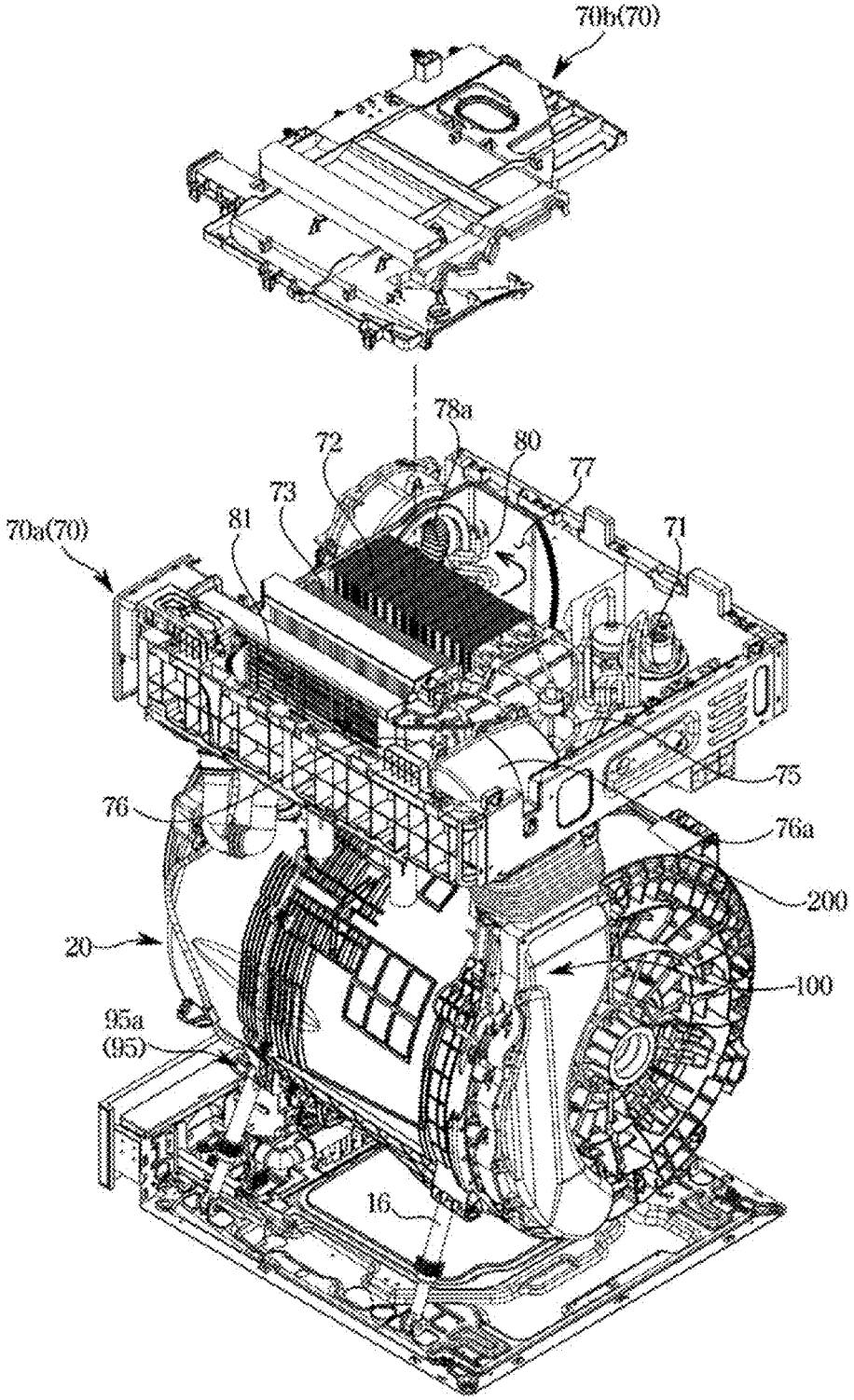
FIG. 4 illustrates a portion of the configuration disposed inside the clothes treating apparatus according to one embodiment of the present disclosure when viewed from a different direction than that illustrated in FIG. 3.
Figure 5:
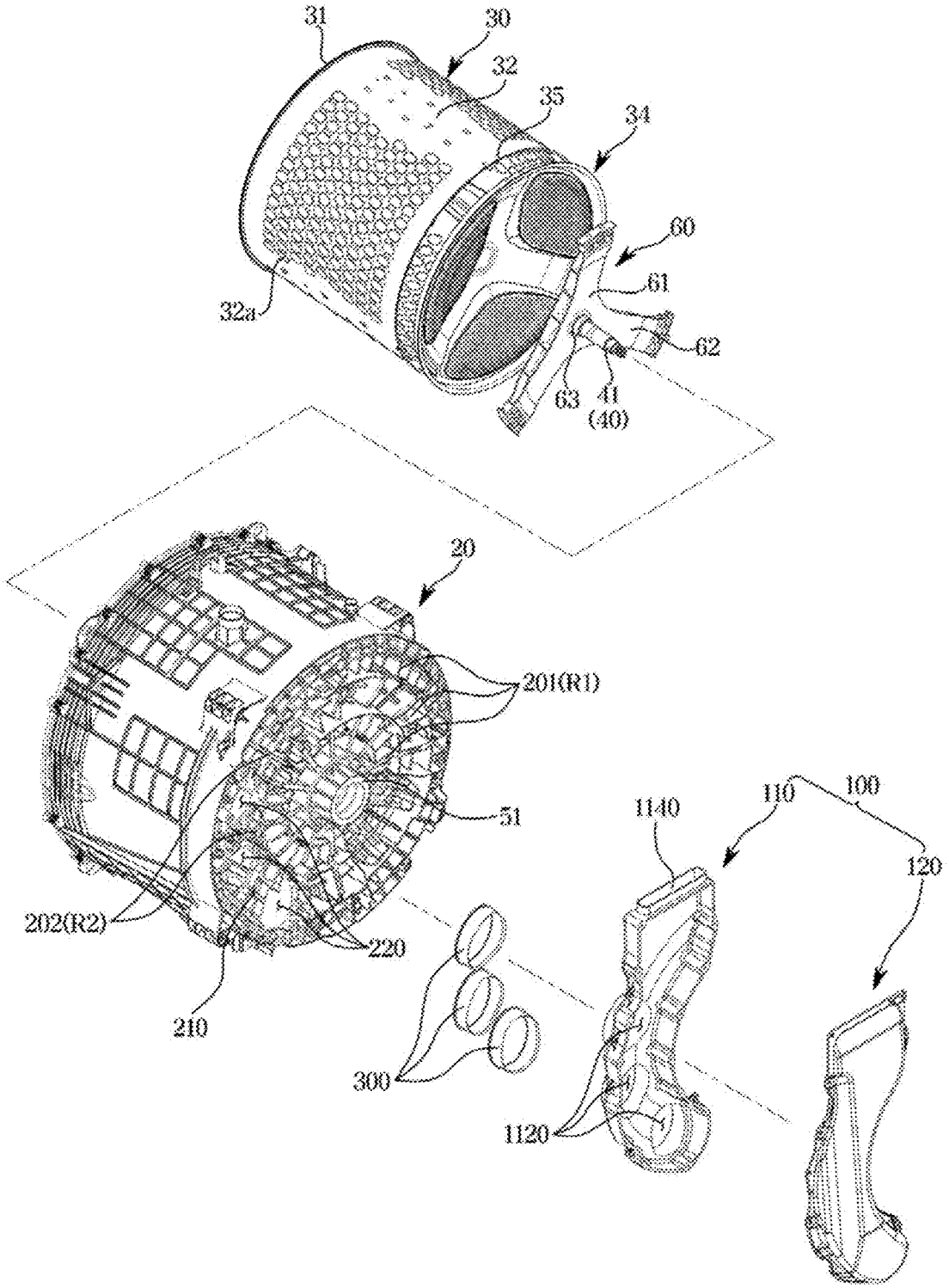
FIG. 5 is an exploded view of a partial configuration of the clothes treating apparatus according to one embodiment of the present disclosure.

FIG. 1 is a perspective view of a clothes treating apparatus according to one embodiment of the present disclosure. FIG. 2 illustrates a cross-section of the clothes treating apparatus according to one embodiment of the present disclosure. FIG. 3 illustrates a portion of a configuration disposed inside the clothes treating apparatus according to one embodiment of the present disclosure. FIG. 4 illustrates a portion of the configuration disposed inside the clothes treating apparatus according to one embodiment of the present disclosure when viewed from a different direction than that illustrated in FIG. 3. FIG. 5 is an exploded view of a partial configuration of the clothes treating apparatus according to one embodiment of the present disclosure.

Referring to FIGS. 1 to 5, a clothes treating apparatus according to one embodiment of the present disclosure may be a combo washer dryer. The clothes treating apparatus 1 includes a housing 10 provided to form an appearance, a tub 20 provided to store water to be used in a washing or rinsing process, a drum 30 provided to accommodate laundry, and a driving device 40 configured to rotate the drum 30.

The housing 10 may be provided in a substantially hexahedral shape. In other words, the housing 10 may be provided in a box shape. The housing 10 may include frames 10*a*, 10*b*, 10*c*, 10*d*, and 10*e*, and the frames 10*a*, 10*b*, 10*c*, 10*d*, and 10*e* may include an upper frame 10*a* forming an upper surface of the housing 10, a front frame 10*b* and a rear frame 10*c* forming a front surface and a rear surface of the housing 10, and a side frame 10*d* and a lower frame 10*e* provided to connect the front frame 10*b* and the rear frame 10*c* and forming a side surface and a lower surface of the housing 10.

A laundry inlet 14 may be formed in the front frame 10*b* of the housing 10 to insert laundry into the drum 30 or withdraw laundry from the drum 30. The laundry inlet 14 may be opened and closed by a door 13 installed on the front frame 10*b* of the housing 10.

The clothes treating apparatus 1 may include the door 13 for opening and closing the laundry inlet 14. The door 13 may be rotatably mounted on the housing 10 by a hinge. At least a portion of the door 13 may be transparent or translucent to allow an inside of the housing 10 to be seen. For example, the door 13 may include tempered glass.

The clothes treating apparatus 1 may include a lower door 18 configured to provide access to a lower detergent supply device 95*a*. The clothes treating apparatus 1 may include an upper door 19 configured to provide access to an upper detergent supply device 95*b* and a filter 81.

A control panel 11 for controlling an operation of the clothes treating apparatus 1 may be arranged in an upper portion of the front frame 10*b* of the housing 10. The control panel 11 may provide a user interface for interaction between a user and the clothes treating apparatus 1. The control panel 11 may be provided with an inputter for inputting the operation of the clothes treating apparatus 1, and a display for displaying various information regarding the clothes treating apparatus 1. For example, the control panel 11 may include a display panel capable of touch input. However, the present disclosure is not limited thereto, and the control panel may include various types of inputters and displays.

The clothes treating apparatus 1 may include the tub 20 disposed inside the housing 10 to store water. The tub 20 may be provided in a substantially cylindrical shape with a tub opening 21 formed on one side, and may be disposed inside the housing 10 to allow the tub opening 21 to correspond to the laundry inlet 14. The tub opening 21 may be arranged to face substantially forward.

The tub 20 may include a tub body 22*a* corresponding to a side surface of the cylinder. The tub body 22*a* may be provided in a cylindrical shape with an open front surface and an open rear surface. The front surface of the tub 20 in which the tub opening 21 is formed may be arranged on the open front surface of the tub body 22*a*. Because the front surface of the tub 20 covers a portion of the open front surface of the tub body 22*a*, the tub opening 21 may be formed to be smaller than the open front surface of the tub body 22*a*. A tub back 200 may be provided on the open rear surface of the tub body 22*a*. The tub back 200 may be provided to cover the open rear surface of the tub body 22*a*. The tub back 200 may be provided to have a size and shape corresponding to the open rear surface of the tub body 22*a* so as to cover the open rear surface of the tub body 22*a*.

The tub 20 may be connected to the housing 10 by a damper 16. The damper 16 may absorb vibration generated when the drum 30 rotates, thereby dampening the vibration transmitted to the housing 10.

The clothes treating apparatus 1 may include the drum 30 provided to accommodate laundry. The drum 30 may be provided in a cylindrical shape. The drum 30 may be disposed inside the housing 10. The drum 30 may be rotatable by receiving power from the driving device 40.

The drum 30 may rotate inside the tub 20 and perform each operation according to the washing, rinsing, and/or spin-drying processes. A plurality of through-holes 32*a* may be formed in the cylindrical wall of the drum 30 to allow water stored in the tub 20 to flow into the drum 30 or flow out of the drum 30.

The clothes treating apparatus 1 may include a water supply device 90 configured to supply water to the tub 20. The water supply device 90 may be disposed above the tub 20. The water supply device 90 may be disposed behind a drying device 70.

The clothes treating apparatus 1 may include the detergent supply device 95 for supplying detergent to the tub 20. The detergent supply device 95 may include the upper detergent supply device 95*b* and the lower detergent supply device 95*a*. The upper detergent supply device 95*b* may be disposed above the tub 20. The lower detergent supply device 95*a* may be disposed under the tub 20. Detergent may be used as a term encompassing pre-laundry detergent, main-laundry detergent, fabric softener, bleach, etc.

The clothes treating apparatus 1 may include a drainage device 93 configured to discharge water contained in the tub 20 to the outside. The drainage device 93 may be disposed below the tub 20. The drainage device 93 may include a drain pump 93*a* for discharging water inside the tub 20 to the outside of the housing 10, a connection hose 93*b* connecting the tub 20 and the drain pump 93*a* to allow the water of the tub 20 to flow into the drain pump 93*a*, and a drain hose provided to guide water, which is pumped by the drain pump 93*a*, to the outside of the housing 10.

The tub 20 may be supported by the damper 16. The damper 16 may connect the lower frame 10*e* of the housing 10 and the outer surface of the tub 20. The damper 16 may be located on the upper, and left and right sides of the housing 10 in addition to the lower frame, thereby supporting the tub 20.

The drum 30 may include a drum body 32, a drum front 31, and a drum back 34.

The drum body 32 may be formed in a hollow cylindrical shape with open front and rear ends. The plurality of through-holes 32*a* may be formed in the cylindrical drum body 32 to allow water stored in the tub 20 to flow into the drum 30 or be discharged out of the drum 30. At least one lifter 33 may be installed on an inner circumferential surface of the drum body 32 to allow laundry to rise and fall when the drum 30 rotates.

The drum front 31 may be disposed at the front end of the drum body 32, and the drum back 34 may be disposed at the rear end of the drum body 32.

A coupling hole 35 may be provided on the side surface of the drum body 32. The coupling hole 35 may be provided at the rear end of the drum body 32 to allow the drum back 34 to be coupled thereto. The coupling hole 35 may be formed in plurality. The coupling hole 35 may be provided to fix a flange shaft 60 installed in the drum back 34. The coupling hole 35 may be formed to correspond to the flange shaft 60. The coupling holes 35 may be formed to be spaced apart at regular intervals along a circumferential direction of the drum body 32 to correspond to the flange shaft 60.

The drum front 31 may be provided to correspond to the front opening of the drum body 32. The drum back 34 may be provided to correspond to the rear opening of the drum body 32.

The drum back 34 may be formed in a disk shape to block the rear opening of the drum body 32. In one embodiment of the present disclosure, a plurality of holes may be formed in the drum back 24 to allow air to easily pass from the inside of the drum to the outside of the drum.

The clothes treating apparatus 1 may include the driving device 40 configured to rotate the drum 30. The driving device 40 may include a drive motor 42 and a rotating shaft 41 connected to the drum 30 to transmit the driving force generated by the drive motor 42 to the drum 30. The rotating shaft 41 for transmitting power of the drive motor 42 may be connected to the drum back 34 of the drum 30. The drum 30 rotates within the tub 20 by the rotational force transmitted through the rotating shaft 41.

The drive motor 42 may be provided outside the tub 20. The drive motor 42 may be connected to the drum 30 through the rotating shaft 41. The rotating shaft 41 penetrates the tub back 200 of the tub 20 and is rotatably supported by a bearing 52 and a bearing housing 51.

The drive motor 42 may include a stator fixed to the outside of the tub back 200 and a rotor configured to rotate and connected to the rotating shaft 41. The stator may electromagnetically interact with the rotor to convert a rotational electrical force into a mechanical rotational force. Rotation of the rotor may be transmitted to the drum 30 through the rotating shaft 41.

The drum back 34 may be connected to the rotating shaft 41 through the flange shaft 60. The flange shaft 60 may be provided to transmit the power of the drive motor 42.

The flange shaft 60 may include a hub portion 61 disposed at the center of the drum back 34 and a plurality of flange portions 62 extending radially from the hub portion 61. A shaft coupling portion 63 for installing the rotating shaft 41 may be formed at the center of the hub portion 61.

The plurality of flange portions 62 may be formed at intervals of approximately 120 degrees around the hub portion 61. The plurality of flange portions 62 may be formed to correspond to a diameter of the drum back 34. A plurality of fastening holes 64 may be formed at one end of each flange portion 62. The plurality of fastening holes 64 may be formed to correspond to the coupling holes 35 of the drum 30. In the embodiment of the present disclosure, it is illustrated that two fastening holes are formed in a single flange portion, but the present disclosure is not limited thereto. For example, the fastening hole may be provided in various numbers and arrangements according to the size and shape of the drum and flange portion.

The rotating shaft 41 may be disposed between the drum 30 and the drive motor 42. One end of the rotating shaft 41 is connected to the drum back 34, and the other end of the rotating shaft 41 extends to the outside of the tub back 200. When the drive motor 42 rotates the rotating shaft 41, the drum 30 connected to the rotating shaft 41 rotates around the rotating shaft 41.

The tub back 200 may be provided with the bearing housing 51 configured to rotatably support the rotating shaft 41. The bearing housing 51 may be formed of aluminum alloy. For example, the bearing housing 51 may be formed of aluminum die casting (ALDC). However, the present disclosure is not limited thereto, and the bearing housing 51 may be formed of stainless steel. It is sufficient that the bearing housing 51 is formed of a material having a strength higher than a material forming the tub 20.

The bearing housing 51 may be coupled to the tub 20. Particularly, the bearing housing 51 may be coupled to the tub back 200. The bearing housing 51 may be inserted into the tub back 200 when the tub 20 is injection molded. Particularly, the tub 20 may be formed by inserting the bearing housing 51 into a mold (not shown) for forming the tub 20 and then by injecting molten resin into the mold. Accordingly, the tub 20 with the bearing housing 51 inserted into the tub back 200 may be formed integrally.

The bearings 52 may be installed between the bearing housing 51 and the rotating shaft 41 to allow the rotating shaft 41 to rotate smoothly.

The clothes treating apparatus 1 may include the drying device 70 for drying laundry accommodated inside the drum 30. The drying device 70 may be configured to heat air and supply the heated air to the inside of the tub 20. The drying device 70 may be configured to dry and heat air discharged from the tub 20 and circulate the dried and heated air inside the tub 20 so as to dry the clothes inside the drum 30. The drying device 70 according to various embodiments may be disposed above the tub 20.

The drying device 70 may include a drying case 70*a* in which a heat pump is installed. The drying case 70*a* may include a drying base 70*b* and a drying cover 70*c* coupled to the drying base 70*b* to form a flow path through which air moves. The drying cover 70*c* may cover an open upper surface of the drying base 70*b*.

The drying device 70 according to various embodiments may be provided as a heat pump type. The drying device 70 may include a compressor 71, a condenser 72, an evaporator 73, an expansion valve, and a refrigerant pipe 75 provided to allow a refrigerant to circulate and to be heat exchanged. The compressor 71, the condenser 72, the evaporator 73, etc. forming the heat pump may be disposed in the drying case 70*a*. For example, the drying device 70 may be mounted on the clothes treating apparatus 1 as one module.

The compressor 71 compresses a refrigerant, and the compressed high-temperature and high-pressure refrigerant is moved to the condenser 72. The condenser 72 may cool the refrigerant and heat the surrounding air. Heated air may flow into the drum 30, thereby drying laundry.

The refrigerant that is expanded by passing through the expansion valve may absorb heat from the evaporator 73 and cool the surrounding air. That is, the evaporator 73 may remove moisture by cooling the hot and humid air passing through the inside of the drum 30. The air from which moisture is removed may pass through the condenser 72 and be heated again while exchanging heat with the refrigerant in the condenser 72. That is, the condenser 72 may heat the air passing through the evaporator 73. The condenser 72 and the evaporator 73 may be referred to as a heat exchanger.

Additionally, in order to increase the drying efficiency, the drying device 70 may further include a heater 80 in addition to the heat pump. However, the present disclosure is not limited thereto. Alternatively, the drying device 70 may include only a heat pump or only a heater 80.

The heater 80 may heat the air introduced into the drying device 70. The heater 80 may be disposed in a heating flow path 77. The heater 80 may be disposed downstream of the condenser 72. Additionally, the heater 80 may be provided in a small size to minimize a flow path resistance. For example, the heater 80 may be a sheath heater.

An inlet flow path 76 through which air discharged from the tub 20 is introduced may be formed in the drying device 70. The heating flow path 77, in which air, which is introduced into the drying device 70 through the inlet flow path 76, is heat-exchanged, may be formed in the drying device 70. The drying device 70 may be provided with a supply flow path 78 through which air, which is heat-exchanged by passing through the heating flow path 77, is supplied to the tub 20.

The inlet flow path 76 is provided to allow air passing through the inside of the tub 20 to flow into the drying device 70. The inlet flow path 76 may be located above the tub 20. The inlet flow path 76 may communicate with an exhaust flow path P formed at the rear side of the tub 20.

The drying device 70 may include an inlet guide 76*a* connected to the tub 20. The inlet guide 76*a* may guide air, which is discharged from the tub 20, to the inlet flow path 76. Through the inlet guide 76*a*, the inlet flow path 76 may communicate with the exhaust flow path P formed in the tub 20. Air passing through the exhaust flow path P may flow into the inlet flow path 76 of the drying device 70 through the inlet guide 76*a*.

The filter 81 may be disposed in the inlet flow path 76 to filter out foreign substances such as lint contained in the air flowing from the tub 20 through the exhaust flow path P. Air introduced into the inlet flow path 76 may flow into the heating flow path 77 by passing through the filter 81.

The condenser 72 and the evaporator 73 may be disposed in the heating flow path 77. Air may be introduced after passing through the inside of the tub 20, and thus the air may be hot and humid. The hot and humid air may be cooled in the evaporator 73 disposed in the heating flow path 77 and thus moisture in the air may be removed. The air may be heated again while passing through the condenser 72.

The supply flow path 78 may supply air, which is heated by passing through the condenser 72, back into the tub 20. The supply flow path 78 may communicate with the heating flow path 77 and may extend downward to discharge the heated air toward the opening of the tub 20.

The drying device 70 may include a blower fan 78*a* to allow air to flow into the tub 20. According to one embodiment, the blower fan 78*a* may be disposed in the supply flow path 78. The blower fan 78*a* may allow air of the heating flow path 77 and the supply flow path 78 to flow into the drum 30. For example, the blower fan 78*a* may include a sirocco fan.

The supply flow path 78 may extend approximately vertically from a front end of the drying base 70*b* toward the tub 20. The front end of the drying base 70*b* may refer to a region adjacent to the front end of the drying base 70*b*. The supply flow path 78 may extend downward from the front end of the drying base 70*b* located above the tub 20 toward the tub 20.

In the clothes treating apparatus 1 according to one embodiment, the supply flow path 78 may be not formed in a method in which the supply flow path extends toward the front side of the front end of the drying base 70*b* and then extends toward the tub 20. However, the supply flow path 78 may directly extend to the lower side toward the tub 20 from the front end of the drying base 70*b*, and thus it is not required to additionally secure a gap between the front frame 10*b* of the housing 10 and the tub 20 to form the supply flow path 78. In other words, it is possible to minimize or prevent that the clothes treating apparatus 1 is increased in the size in the front and rear direction to secure the supply flow path 78.

The clothes treating apparatus 1 may include the exhaust flow path P for allowing air discharged from the tub 20 to flow into the drying device 70. The exhaust flow path P may be connected to the inlet flow path 76 of the drying device 70.

The exhaust flow path P may be provided to discharge humid air, which is discharged from the inside of the drum 30 to the tub 20, to the outside of the tub 20. For example, the exhaust flow path P may be provided at the rear side of the tub 20.

The exhaust flow path P, the inlet flow path 76, the heating flow path 77, and the supply flow path 78 may circulate air into the inside of the tub 20 and the drying device 70.

In the clothes treating apparatus 1 according to one embodiment, the exhaust flow path P may be formed by coupling an exhaust duct 100 to the tub back 200. Particularly, the exhaust duct 100 may be formed by coupling a duct cover 120 to a duct body 110. The exhaust flow path P may be formed inside the exhaust duct 100. A structure in which the exhaust duct 100 is coupled to the tub back 200 may be provided in various ways.

The exhaust duct 100 may be provided to allow air discharged from a tub exhaust port 220 to be introduced thereinto. The air discharged from the tub exhaust port 220 may flow into the inside of the duct body 110 through a duct exhaust port 1120 of the duct body 110. The air introduced through the duct exhaust port 1120 may flow to the drying device 70 along the exhaust flow path P.

The tub 20 according to one embodiment may include a reinforcing rib 201 and a cut rib 202 formed on a rear surface of the tub back 200. The front surface of the tub back 200 may refer to one surface of the tub back 200 disposed inside the tub 20, and the rear surface of the tub back 200 may refer to the other surface of the tub back 200 disposed outside the tub 20.

The reinforcing rib 201 may be formed to reinforce a strength of the tub back 200. The reinforcing rib 201 may protrude rearward from the rear surface of the tub back 200. The cut rib 202 may protrude rearward from the rear surface of the tub back 200, but may have a lower protruding height than the reinforcing rib 201. The cut rib 202 may be manufactured to have a lower protruding height when the tub 20 is injection-molded. Alternatively, the cut rib 202 may be formed by cutting a predetermined length from an end of the reinforcing rib 201.

Air heated by the drying device 70 may be introduced into the tub 20 and then supplied into the drum 30. At this time, it is required to secure a region in which the heated air supplied into the drum 30 comes into contact with the laundry. The longer the distance and time for the heated air to flow inside the drum 30, the more air may come into contact with laundry. For this, the tub exhaust port 220 may be formed in a position opposite to an air inlet 26 through which air, which is heated in the drying device 70, flows into the tub 20.

The air inlet 26, into which the air heated by the drying device 70 flows, and the tub exhaust port 220, through which air inside the tub 20 is discharged, may be arranged to be spaced apart from each other as possible as. For this, the air inlet 26 and the tub exhaust port 220 may be located diagonally when the tub 20 is viewed from the front or the rear.

For example, when the air inlet 26 is formed at a right upper end of the front surface of the tub 20 or at a position adjacent to the right upper end of the front surface of the tub 20, the tub exhaust port 220 may be formed at a left lower end of the tub back 200 or at a position adjacent to the left lower end of the tub back 200. In this case, the heated air may move from the right upper end of the front surface of the tub 20 toward the left lower end of the tub back 200, and thus the heated air may move in the similar direction in the drum 30 disposed inside the tub 20. That is, the heated air may move diagonally from the right upper end of the front surface of the drum 30 toward the left lower end of the rear surface of the drum 30. Accordingly, a movement path of the heated air may be maximally increased inside the drum 30. As the movement path of the heated air becomes longer, the heated air may come into contact with the laundry inside the drum 30 over a large area for a long time, and the drying efficiency of the clothes treating apparatus 1 may be improved.

However, the present disclosure not limited thereto, and the air inlet 26 and the tub exhaust port 220 may be provided at different positions according to the area of the air inlet 26 and the tub exhaust port 220 and/or the air volume of the blower fan 78*a*.

The clothes treating apparatus 1 may include the duct cover 120 coupled to the tub 20 to cover the duct body 110.

The exhaust flow path P may be formed as the duct cover 120 covers one open side of the duct body 110. When the duct cover 120 is coupled to the tub 20, the exhaust duct 100, in which the exhaust flow path P is formed, may be formed.

The duct body 110 may further include a duct connector 1140 provided to protrude to the upper side of the duct body 110. However, the present disclosure is not limited thereto, and the duct connector 1140 may be positioned in various ways according to the position of the drying device 70.

The duct connector 1140 may be connected to the inlet guide 76*a* of the drying device 70. The duct connector 1140 may extend the exhaust flow path P upward. The duct connector 1140 may form a portion of the exhaust flow path P.

The duct connector 1140 may be formed in a rectangular parallelepiped shape with an open upper surface.

Because the exhaust flow path P is connected to the inlet flow path 76, air, which flows to the exhaust flow path P through the tub exhaust port 220 formed in the tub back 200, may move along the exhaust flow path P and flow into the drying device 70 through the inlet flow path 76.

Figure 6:
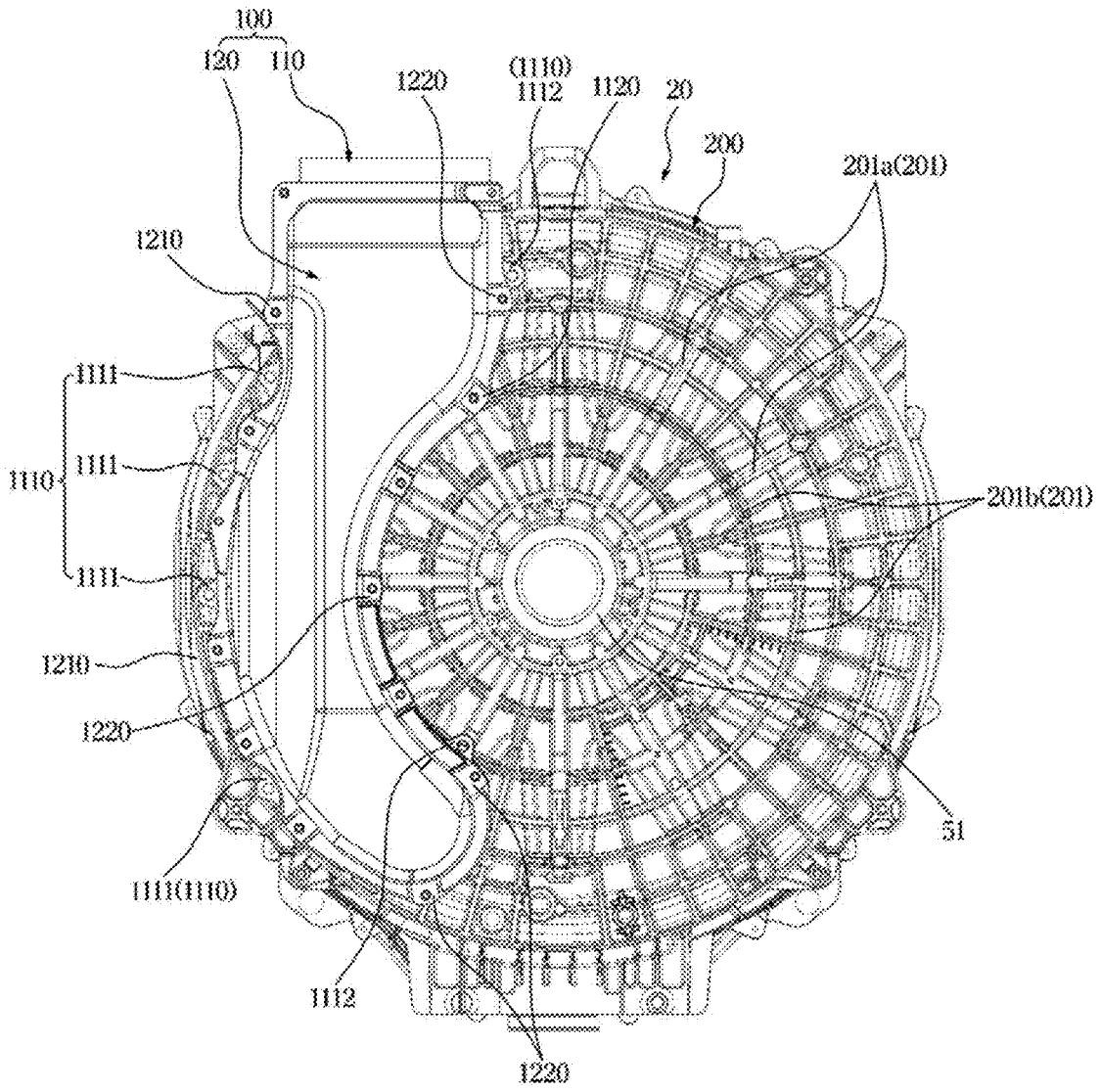
FIG. 6 is a rear view of a tub and an exhaust duct according to one embodiment of the present disclosure.
Figure 7:
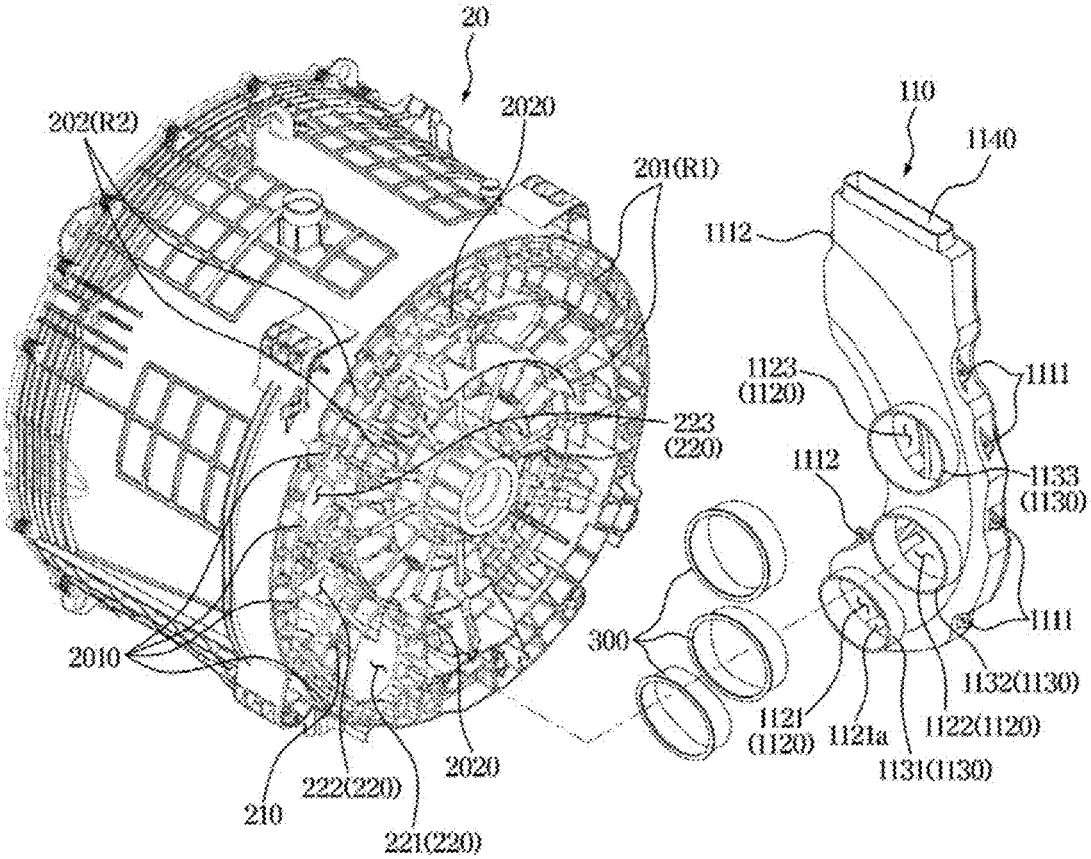
FIG. 7 is a view illustrating a state in which the tub and a duct body are separated from each other according to one embodiment.
Figure 8:
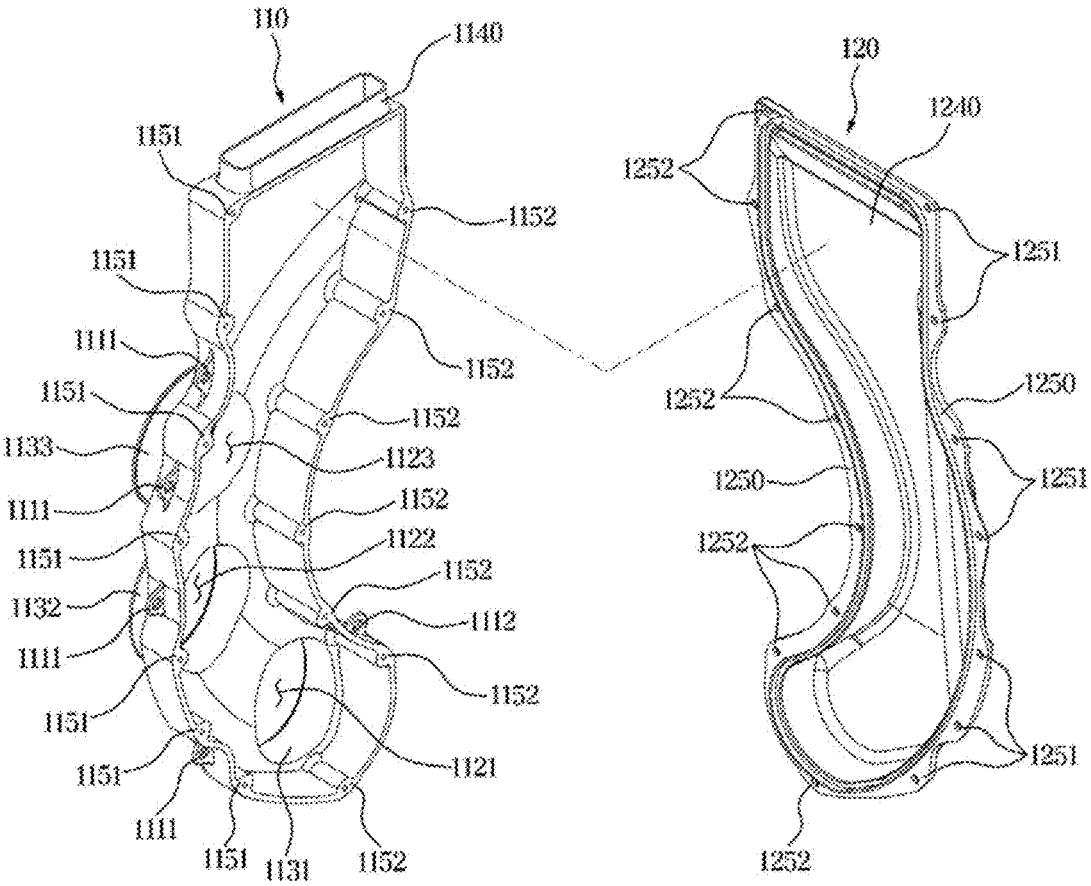
FIG. 8 is a view illustrating a state in which the duct body and a duct cover are separated from each other according to one embodiment.

FIG. 6 is a rear view of a tub and an exhaust duct according to one embodiment of the present disclosure. FIG. 7 is a view illustrating a state in which the tub and a duct body are separated from each other according to one embodiment. FIG. 8 is a view illustrating a state in which the duct body and a duct cover are separated from each other according to one embodiment.

Referring to FIGS. 6 to 8, the tub 20 may include the tub back 200 forming the rear surface of the tub 20.

The tub back 200 may include a plurality of reinforcing ribs 201 formed to withstand a rotational force and hydraulic pressure of the driving device. The plurality of reinforcing ribs 201 may protrude from the tub back 200. Particularly, the plurality of reinforcing ribs 201 may protrude rearward from the tub back 200.

The plurality of reinforcing ribs 201 may include a plurality of annular ribs 201*b* and a plurality of radial ribs 201*a*. The plurality of annular ribs 201*b* may be arranged in a concentric circle shape with respect to the center of the bearing housing 51. The plurality of radial ribs 201*a* may be in a shape extending radially from the center of the bearing housing 51.

The plurality of reinforcing ribs 201 may be formed in at least a portion of the tub back 200. A portion, in which the plurality of reinforcing ribs 201 is formed, in an area forming the tub back 200 may be referred to as a first region R1.

The tub back 200 may include the cut ribs 202 having the height lower than the reinforcing ribs 201 among the plurality of reinforcing ribs 201. The cut ribs 202 may be formed by cutting a portion of the reinforcing ribs 201. Alternatively, the cut ribs 202 may be formed to have a lower height than the reinforcing ribs 201 when the tub 20 is injection-molded. A portion in which the plurality of cut ribs 202 is formed may be referred to as a second region R2.

Because the plurality of reinforcing ribs 201 and the plurality of cut ribs 202 have different heights, the first region R1 and the second region R2 may have different heights. The first region R1 and the second region R2 may be formed to be stepped.

The tub back 200 may be provided to allow the exhaust duct 100 to be mounted on the second region R2. The second region R2 may be formed to have a lower protruding height than the first region R1. Accordingly, even when the exhaust duct 100 is installed in the tub back 200, a length of the exhaust duct 100 that protrudes rearward may be reduced. In other words, the length of the exhaust duct 100 protruding rearward may be reduced when the exhaust duct 100 is installed in the second region R2 compared to when the exhaust duct 100 is installed in the first region R1.

In the tub back 200, the cut ribs 202 of the second region R2 may have a lower protruding height than the reinforcing ribs 201 of the first region R1. That is, the strength of the second region R2 of the tub back 200 may be reduced compared to the first region R1.

The exhaust duct 100 may be provided to reinforce the strength of the tub 20. The exhaust duct 100 may include a material having a strength equal to that of the tub 20. It is appropriate that the exhaust duct 100 includes a material having a strength higher than the material forming the tub 20. For example, the exhaust duct 100 may include PPS, aluminum die casting (ALDC), iron plate, etc.

The exhaust duct 100 may include the duct body 110 mounted on a duct mounting portion 210. In addition, the exhaust duct 100 may include the duct cover 120 provided to be coupled to the duct body 110. The duct body 110 may include a material that is equal to or stronger than the material forming the tub 20. However, the present disclosure is not limited thereto, and the duct cover 120 may also include a material that is equal to or stronger than the material forming the tub 20.

In a state in which the exhaust duct 100 is mounted on the duct mounting portion 210, the exhaust duct 100 may be coupled to the tub 20 and/or the bearing housing 51.

The exhaust duct 100 may include tub coupling portions 2010 and 2020 configured to be coupled to the tub 20.

The tub coupling portions 2010 and 2020 may be formed along periphery of the duct mounting portion 210. The tub coupling portions 2010 and 2020 may include a first tub coupling portion 2010 formed on an outer side of the duct mounting portion 210. In other words, the first tub coupling portion 2010 may be formed along the outer circumference of the tub back 200. In other word, the first tub coupling portion 2010 may be formed along a cylindrical surface forming the tub 20.

The tub coupling portions 2010 and 2020 may include a second tub coupling portion 2020 formed on an inner side of the duct mounting portion 210. The second tub coupling portion 2020 may be formed at a portion, in which the first region R1 meets the second region R2, of the tub back 200.

The duct body 110 may include a duct body coupling portion 1110 provided to correspond to the tub coupling portions 2010 and 2020. The duct body coupling portion 1110 may be provided on a side surface of the duct body 110. That is, the duct body coupling portion 1110 may be provided on a circumferential surface of the duct body 110.

The duct body coupling portion 1110 and the tub coupling portions 2010 and 2020 may be coupled to each other through a fastening member. In the state in which the duct body 110 mounted on the duct mounting portion 210, the fastening member may be inserted into the duct body coupling portion 1110 and the tub coupling portions 2010 and 2020 to be coupled to each other.

The duct body coupling portion 1110 may include a first duct body coupling portion 1111 corresponding to the first tub coupling portion 2010. In addition, the duct body coupling portion 1110 may include a second duct body coupling portion 1112 corresponding to the second tub coupling portion 2020.

The exhaust duct 100 may include duct coupling portions 1210 and 1220 to which the duct body 110 and the duct cover 120 are coupled.

The duct coupling portions 1210 and 1220 may include a first duct coupling portion 1210, which is located farther away from the center of the tub back 200, in the exhaust duct 100. The first duct coupling portion 1210 may be a portion to which the duct body 110 and the duct cover 120 are coupled.

The duct coupling portions 1210 and 1220 may include a second duct coupling portion 1220 located in the perimeter, which is adjacent to the center of the tub back 200, of the exhaust duct 100. The second duct coupling portion 1220 may be a portion to which the duct body 110 and the duct cover 120 are coupled.

Only the duct body 110 and the duct cover 120 may be coupled to the duct coupling portions 1210 and 1220. In addition, the duct cover 120 and the bearing housing 51 may be coupled as one piece with the duct body 110 interposed therebetween.

The duct coupling portions 1210 and 1220 may be coupled in various ways. For example, the duct coupling portions 1210 and 1220 may be coupled as body coupling holes 1151 and 1152 and cover coupling holes 1251 and 1252 are coupled through a fastening member. This is only an example, and various other coupling methods may be used.

Referring to FIGS. 7 and 8, the coupling structure of the duct body 110 and the tub 20, and the duct body 110 and the duct cover 120 will be described.

Referring to FIG. 7, the tub back 200 may include the tub exhaust port 220 provided to discharge air inside the tub 20. The tub exhaust port 220 may be provided to discharge air containing moisture of laundry inside the tub 20.

The tub exhaust port 220 may be formed in the tub back 200. Particularly, the tub exhaust port 220 may be provided in the duct mounting portion 210. Air discharged through the tub exhaust port 220 may be provided to flow into the exhaust duct 100 mounted on the duct mounting portion 210.

The inside of the tub 20 and the exhaust duct 100 may communicate with each other to allow air, which is discharged through the tub exhaust port 220, to flow through the exhaust duct 100. The exhaust duct 100 according to one embodiment of the present disclosure may include the duct exhaust port 1120 formed to correspond to the tub exhaust port 220.

The duct exhaust port 1120 may be provided to allow air discharged from the tub exhaust port 220 to flow into the exhaust duct 100.

The duct body 110 may include a duct inserting portion 1130 protruding toward the tub exhaust port 220. The duct inserting portion 1130 may be inserted into the tub exhaust port 220. The duct inserting portion 1130 may be configured to be inserted into the tub exhaust port 220 to allow the duct body 110 to be coupled to the tub 20.

The duct inserting portion 1130 may be formed along the circumference of the duct exhaust port 1120. The duct inserting portion 1130 may protrude from the circumference of the duct exhaust port 1120. Particularly, the duct inserting portion 1130 may protrude toward the tub 20.

The duct inserting portion 1130 may have a predetermined length to be inserted into the tub exhaust port 220. A circumference of the duct inserting portion 1130 may correspond to the circumference of the duct exhaust port 1120. The duct inserting portion 1130 may be inserted into the tub exhaust port 220 to allow the inside of the tub 20 and the inside of the exhaust duct 100 to communicate with each other.

Air inside the tub 20 may flow into the exhaust duct 100 through the duct inserting portion 1130 inserted into the tub exhaust port 220. A passage formed by the duct inserting portion 1130 may communicate with the duct exhaust port 1120.

The tub exhaust port 220 may include a first tub exhaust port 221 formed on the lower side of the duct body 110, a second tub exhaust port 222 formed above the first tub exhaust port 221, and a third tub exhaust port 223 formed above the second tub exhaust port 222.

The second tub exhaust port 222 may be formed at a position spaced upward from the first tub exhaust port 221. The second tub exhaust port 222 may be positioned above the first tub exhaust port 221. The second tub exhaust port 222 may be positioned below the center of the tub back 200. Because the second tub exhaust port 222 is positioned to allow a gap to be formed between the second tub exhaust port 222 and the first tub exhaust port 221, it is possible to prevent a decrease in the strength compared to a case in which the second tub exhaust port 222 and the first tub exhaust port 221 are formed integrally.

The third tub exhaust port 223 may be formed at a position spaced upward from the second tub exhaust port 222. An air flow rate may be secured while preventing a decrease in the strength of the tub back 200.

As mentioned above, three tub exhaust ports 220 may be formed. Three duct exhaust ports 1120 may also be formed to correspond to the tub exhaust port 220. Three duct inserting portions 1130 may also be formed because the duct inserting portion 1130 protrudes from each duct exhaust port 1120.

The duct inserting portion 1130 may be inserted into the tub exhaust port 220 to improve a bonding force between the duct body 110 and the tub 20. By providing the plurality of duct inserting portions 1130 and the plurality of tub exhaust ports 220, the bonding force may be further improved.

The duct inserting portion 1130 may include a first duct inserting portion 1131 provided to be inserted into the first tub exhaust port 221 located at the lowest among the tub exhaust ports 220. The first duct inserting portion 1131 may include a drainage groove 1121*a* provided to prevent moisture from remaining in the first duct inserting portion 1131.

The drainage groove 1121*a* may be formed to be inclined downward along a protruding direction of the first duct inserting portion 1131 to allow moisture remaining in the first duct inserting portion 1131 to flow into the inside of the tub 20. The drainage groove 1121*a* may extend along a longitudinal direction of the first duct inserting portion 1131. That is, the drainage groove 1121*a* may be provided in a groove shape to allow moisture to flow into the inside of the tub 20.

The drainage groove 1121*a* may be formed not only in the first duct inserting portion 1131, but also in a second duct inserting portion 1132 and/or a third duct inserting portion 1133.

The duct inserting portion 1130 may include the second duct inserting portion 1132 and the third duct insert 1133 that are provided to be inserted into the second tub exhaust port 222 and the third tub exhaust port 223. In the present disclosure, it is illustrated that three duct inserting portions 1130 are provided to correspond to the number and positions of the tub exhaust ports 220, but is not limited thereto. The tub exhaust ports 220 may be formed in various numbers, sizes, or positions on the tub back 200, and it is sufficient for the duct inserting portion 1130 to be formed to correspond to the tub exhaust port 220.

The duct body 110 may include a discharge portion 1140 provided to allow air inside the exhaust duct 100 to flow to the drying device. The discharge portion 1140 may be located on the upper side of the duct body 110. The discharge portion 1140 may be formed to protrude upward from the exhaust duct 100.

The exhaust duct 100 may be formed by coupling the duct cover 120 to the duct body 110. The duct cover 120 may be coupled to the duct body 110 while the duct body 110 is mounted on the duct mounting portion 210.

The duct body 110 may include the body coupling holes 1151 and 1152 provided to allow the duct cover 120 to be coupled thereto. A plurality of body coupling holes 1151 and 1152 may be arranged along the perimeter of the duct body 110. The body coupling holes 1151 and 1152 may be arranged spaced apart from each other along the perimeter of the duct body 110.

The duct body 110 may include the cover coupling holes 1251 and 1252 provided to correspond to the body coupling holes 1151 and 1152. The cover coupling holes 1251 and 1252 may be formed in a number corresponding to the body coupling holes 1151 and 1152. In addition, the cover coupling holes 1251 and 1252 may be arranged at positions corresponding to the body coupling holes 1151 and 1152.

The body coupling holes 1151 and 1152 may include a first body coupling hole 1151 located along the outer circumference of the tub back 200 and a second body coupling hole 1152 located within the outer circumference of the tub back 200.

The cover coupling holes 1251 and 1252 may include a first cover coupling hole 1251 provided to be coupled to the first body coupling hole 1151, and a second cover coupling hole 1252 provided to be coupled to the second body coupling hole 1152.

A portion to which the first body coupling hole 1151 and the first cover coupling hole 1251 are coupled may be referred to as the first duct coupling portion 1210 (refer to FIG. 6). In addition, a portion to which the second body coupling hole 1152 and the second cover coupling hole 1252 are coupled may be referred to as the second duct coupling portion 1220 (refer to FIG. 6).

In the state in which the duct cover 120 is seated on the duct body 110, the duct cover 120 may be fastened to the duct body 110 through a fastening member. The fastening member may be inserted into the body coupling holes 1151 and 1152 and the cover coupling hole 1251 and 1252. The fastening member may include a bolt, a rivet, or the like.

The duct cover 120 may be coupled to the bearing housing 51 with the duct body 110 interposed therebetween. The body coupling holes 1151 and 1152 may be formed to be penetrated to allow the fastening member to pass through the duct body 110 and reach the bearing housing 51. That is, the fastening member may be inserted into the bearing housing 51 by sequentially passing through the cover coupling holes 1251 and 1252 and the body coupling holes 1151 and 1152.

A fastening hole (not shown), to which the fastening member is coupled, may be formed in the bearing housing 51. The fastening hole may be positioned to correspond to the cover coupling holes 1151 and 1152 and the body coupling holes 1251 and 1252. That is, the duct cover 120, the duct body 110, and the bearing housing 51 may all be coupled by a single fastening member.

The cover coupling holes 1151 and 1152 of the duct body 110 may include the first body coupling hole 1151 provided to be coupled to a side on the circumference of the tub back 200. The first body coupling portion 1151 may be located on a side far from the first region R1 of the duct mounting portion 210.

The cover coupling holes 1151 and 1152 of the duct body 110 may include the second body coupling hole 1152 provided at a boundary between the first region R1 and the second region R2. The second body coupling hole 1152 may be located on the inner side of the tub back 200 than the first body coupling hole 1151.

The duct cover 120 may include a cover body 1240. The cover body 1240 may protrude in a direction away from the duct body 110 so as to secure a flow path for air flowing inside the exhaust duct 100.

The duct cover 120 may include a flange portion 1250 extending outward from the cover body 1240. The flange portion 1250 may extend along a perimeter of the cover body 1240.

The cover coupling holes 1251 and 1252 may be formed on the flange portion 1250. The cover coupling holes 1251 and 1252 may be spaced apart from each other along the flange portion 1250. That is, the cover coupling holes 1251 and 1252 may be disposed along the perimeter of the duct cover 120.

The cover coupling holes 1251 and 1252 may include the first cover coupling hole 1251 corresponding to the first body coupling hole 1151 of the duct body 110. The first cover coupling hole 1251 may be coupled to a side on the circumference of the tub back 200 to correspond to the first body coupling hole 1151.

The cover coupling holes 1251 and 1252 may include the second cover coupling hole 1252 corresponding to the second body coupling hole 1152 of the duct body 110. The second cover coupling hole 1252 may be located at the boundary between the first region R1 and the second region R2 to correspond to the second body coupling hole 1152.

The exhaust duct 100 may form the exhaust flow path P by coupling the duct body 110 and the duct cover 120. In order for the air inside the tub 20 to flow into the exhaust duct 100, it is required to maintain airtightness between the tub 20 and the exhaust duct 100. Particularly, airtightness may be required between the tub exhaust port 220 and the duct inserting portion 1130.

The exhaust duct 100 may include a sealing member 300 for sealing between the tub 20 and the exhaust duct 100. The sealing member 300 may be disposed on the outside of the duct inserting portion 1130 to prevent air discharged from the drum 30 from flowing out between the tub exhaust port 220 and the duct inserting portion 1130. The sealing member 300 may have a cylindrical shape with a predetermined length, which is similar to the duct inserting portion 1130.

Hereinafter a description regarding one embodiment different from the exhaust duct 100 of FIGS. 6 to 9 will be described. A reference numeral of the same component may be omitted and only different component will be described in detail.

Figure 9:
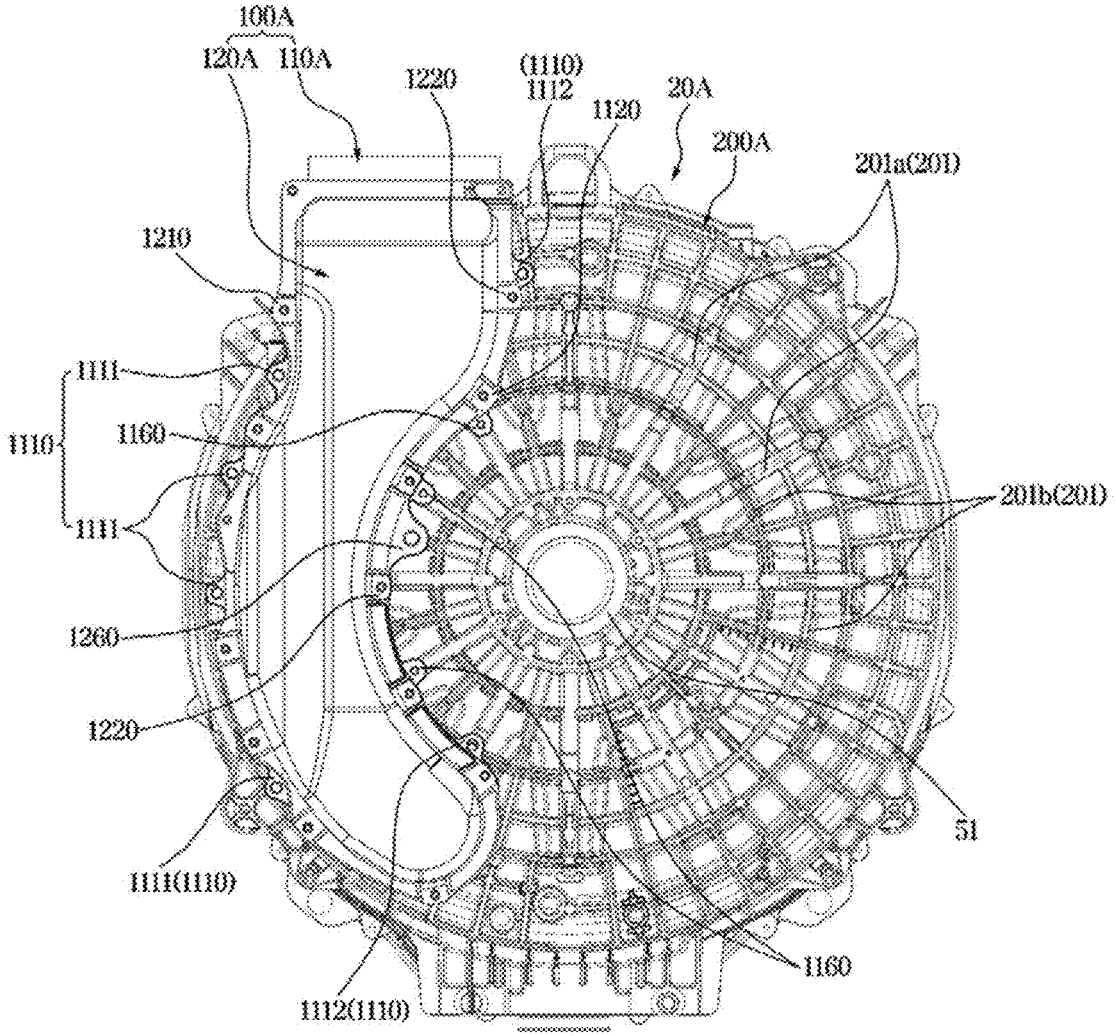
FIG. 9 is a rear view of a tub and an exhaust duct according to one embodiment.
Figure 10:
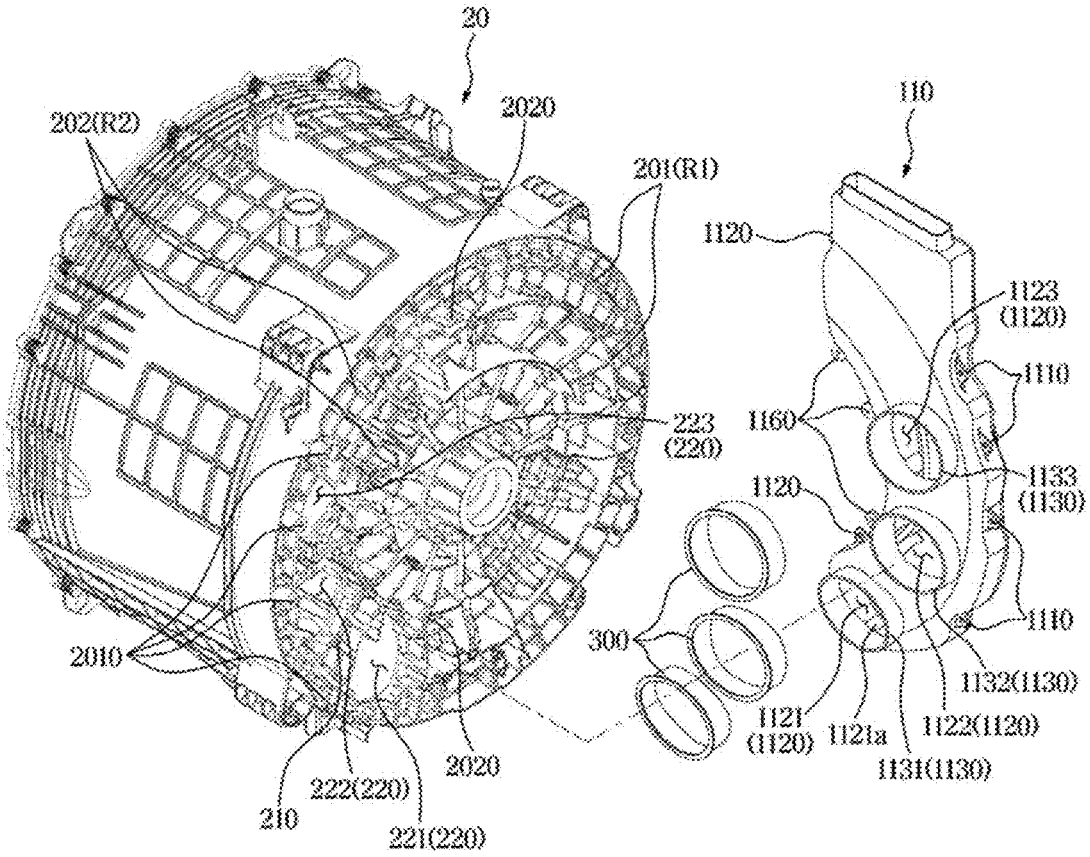
FIG. 10 is a view illustrating a state in which the tub and a duct body are separated from each other according to one embodiment.
Figure 11:
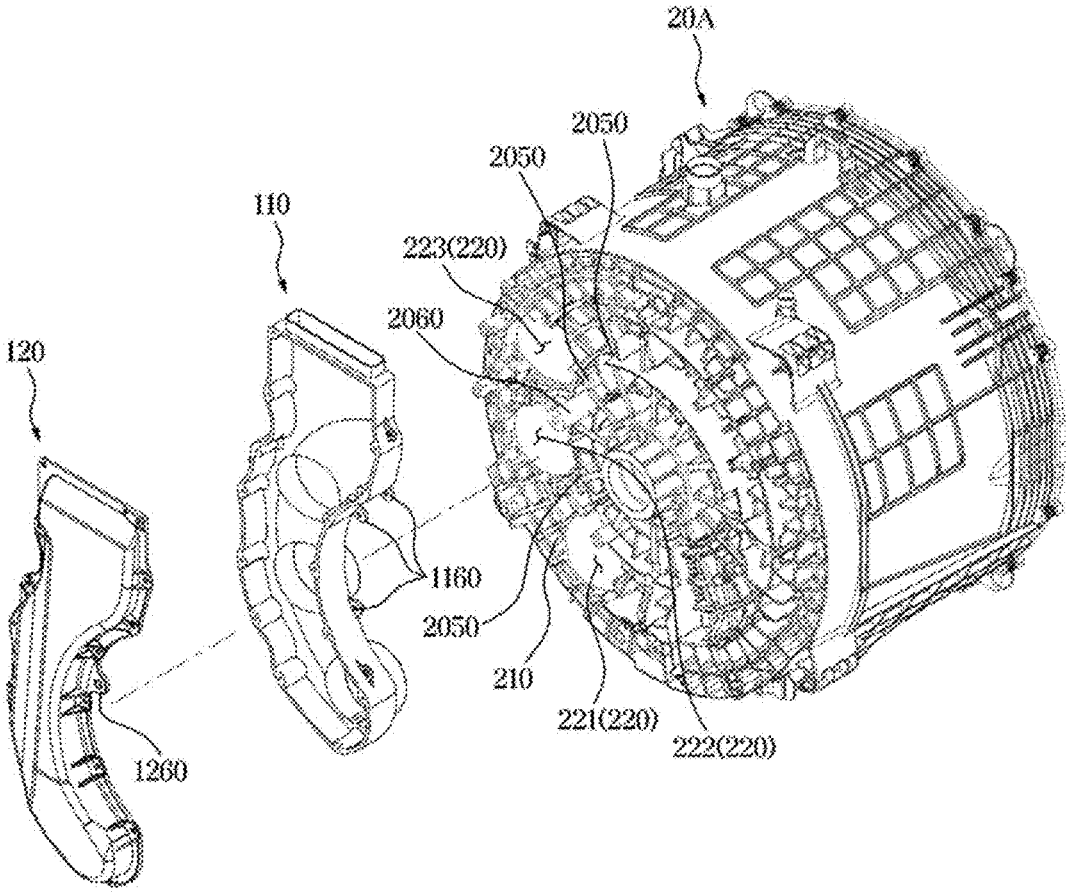
FIG. 11 is a view illustrating a state in which the duct body and a duct cover are separated from each other according to one embodiment.
Figure 12:
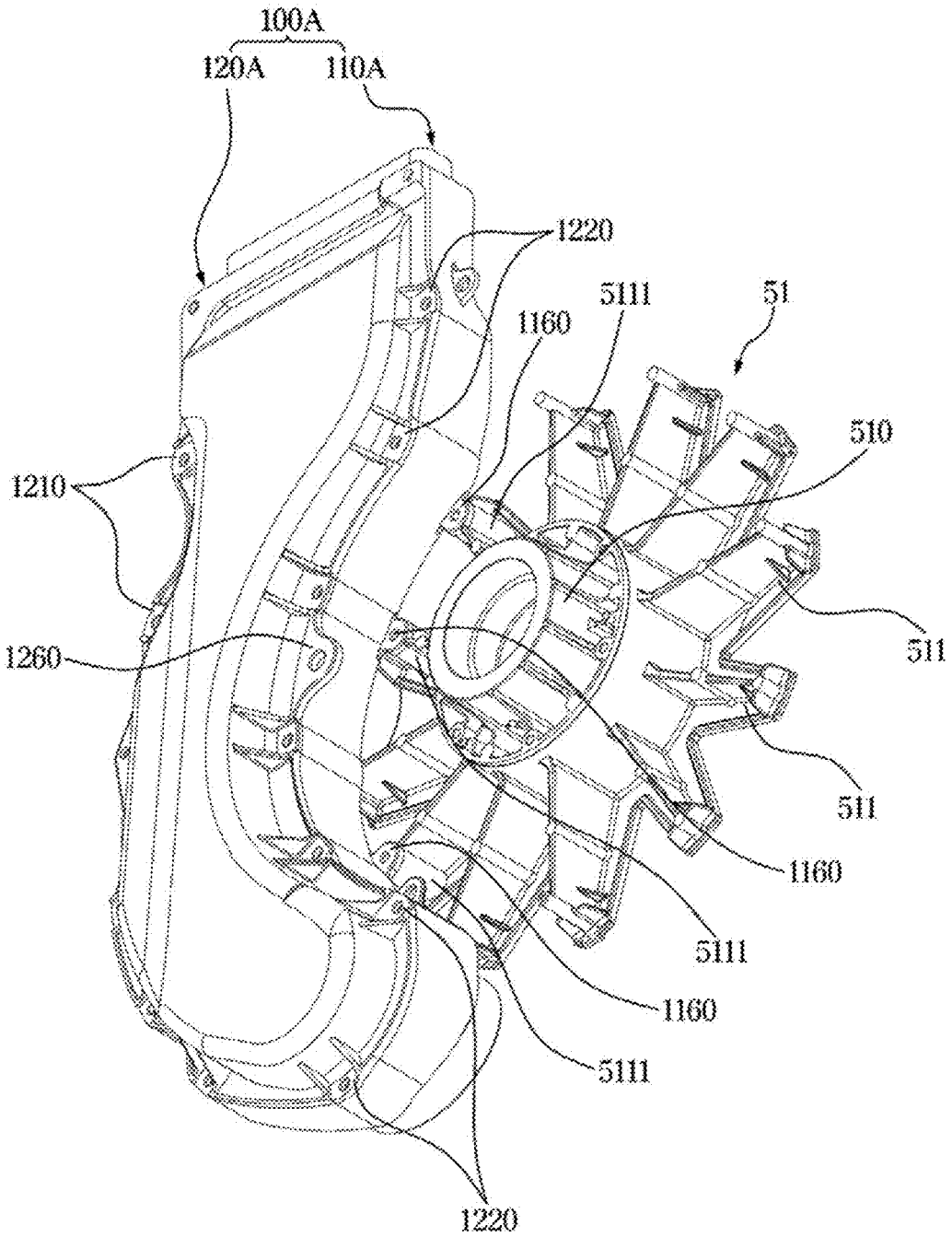
FIG. 12 is a view illustrating a state in which the exhaust duct is coupled to a bearing housing.
Figure 13:
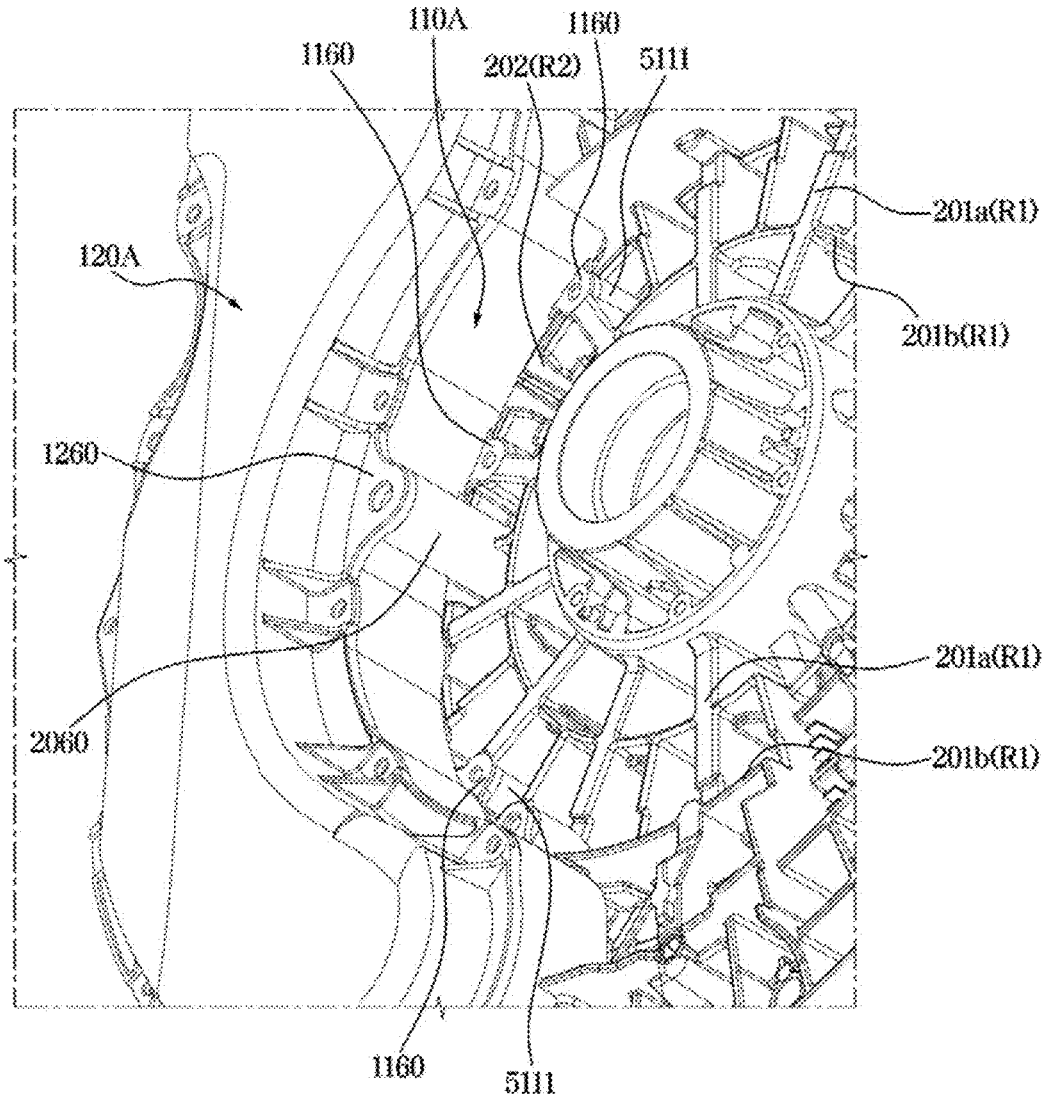
FIG. 13 is a view illustrating a state in which the exhaust duct is coupled to the tub and the bearing housing inserted into the tub.

FIG. 9 is a rear view of a tub and an exhaust duct according to one embodiment. FIG. 10 is a view illustrating a state in which the tub and a duct body are separated from each other according to one embodiment. FIG. 11 is a view illustrating a state in which the duct body and a duct cover are separated from each other according to one embodiment. FIG. 12 is a view illustrating a state in which the exhaust duct is coupled to a bearing housing. FIG. 13 is a view illustrating a state in which the exhaust duct is coupled to the tub and the bearing housing inserted into the tub.

Referring to FIGS. 9 to 13, an exhaust duct 100A may be coupled to a tub back 200A.

A duct body 110A may be coupled to the tub back 200A as described above. Particularly, the duct body 110A may be coupled to the tub coupling portion.

The duct body 110A may be coupled to the bearing housing 51. The duct body 110A may be coupled to a leg portion 511 of the bearing housing 51. A housing protrusion 5111 may be formed at an end of the leg portion 511. A portion of the housing protrusion 5111 may be coupled to the duct body 110A. Particularly, the housing protrusion 5111 located adjacent to the duct body 110A may be coupled to the duct body 110A.

The housing protrusion 5111 may protrude toward the duct body 110A. The bearing housing 51 may protrude toward the duct body 110A while the bearing housing 51 is inserted into the tub back 200A. That is, the housing protrusion 5111 may penetrate the tub back 200A and be exposed to the outside.

The housing protrusion 5111 may include a fastening hole (not shown) for being coupled to the duct body 110A. The duct body 110A may be provided to be coupled to the housing protrusion 5111 through a fastening member.

The duct body 110A may include a body coupling portion 1160 provided to be coupled to the bearing housing 51. The body coupling portion 1160 may be provided to correspond to the housing protrusion 5111. The body coupling portion 1160 may include a fastening hole (not shown) for being coupled to the housing protrusion 5111. The body coupling portion 1160 may be formed at a position and in a number corresponding to the housing protrusion 5111.

In addition, the body coupling portion 1160 may be arranged along a perimeter of the duct body 110A. The body coupling portion 1160 may protrude from a side surface of the duct body 110A. A coupling hole for being coupled to a fastening hole (not shown) may be formed in the body coupling portion 1160.

The tub back 200A may include a tub protrusion 2060 to which a duct cover 120A is coupled. The tub protrusion 2060 may protrude further than a height at which the reinforcing rib 201 protrudes. Particularly, the tub protrusion 2060 may protrude to a height that is allowed to be coupled to the duct cover 120A in a state in which the exhaust duct 100A is coupled to the tub back 200A. The tub protrusion 2060 may be provided with a fastening hole to allow a fastening member to be inserted thereinto.

The duct cover 120A may include a cover coupling portion 1260 corresponding to the tub protrusion 2060. The cover coupling portion 1260 may be formed outward from the flange portion 1250. The cover coupling portion 1260 may be coupled to the tub protrusion 2060 through a fastening member. However, the coupling method is not limited thereto, and may be coupled in various ways.

Accordingly, the exhaust duct 100A may be coupled to each of a tub 20A and the bearing housing 51. Particularly, the duct body 110A may be coupled to both the tub 20A and the bearing housing 51. The duct cover 120A may also be coupled to both the tub 20A and the bearing housing 51.

Because the exhaust duct 100A is coupled to the second region R2 in which the cut rib 202 is formed, the strength may be reduced compared to the first region R1 in which the plurality of radial reinforcing ribs 201*a* and the plurality of annular reinforcing ribs 201*b* are formed. The exhaust duct 100A may be provided to reinforce the strength of the second region R2.

The exhaust duct 100A may be coupled to the bearing housing 51 inserted into the tub back 200A. Particularly, the duct body 110A may be coupled to the bearing housing 51. The duct body 110A may include the same material as the bearing housing 51. However, the present disclosure is not limited thereto, and it is sufficient that the duct body 110A includes a material that is equal to or stronger than the material forming the tub 20A.

The exhaust duct 100A, the tub 20A, and the bearing housing 51 may be coupled to each other. The exhaust duct 100A, the tub 20A, and the bearing housing 51 may support each other by being coupled to each other. Due to the structure for fixing and coupling the exhaust duct 100A according to one embodiment of the present disclosure, the structural strength of the second region R2 may be reinforced.

Figure 14:
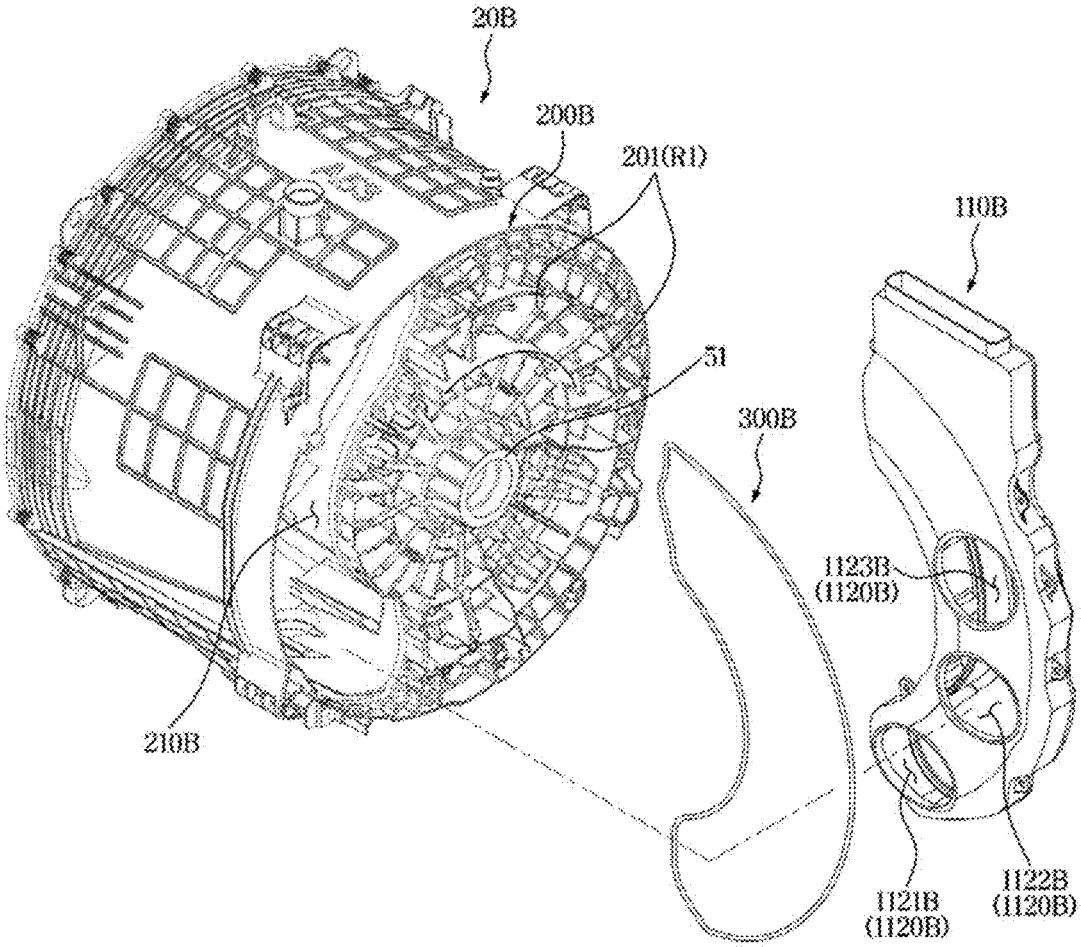
FIG. 14 is a view illustrating a state in which a tub and an exhaust duct are separated from each other according to one embodiment.
Figure 15:
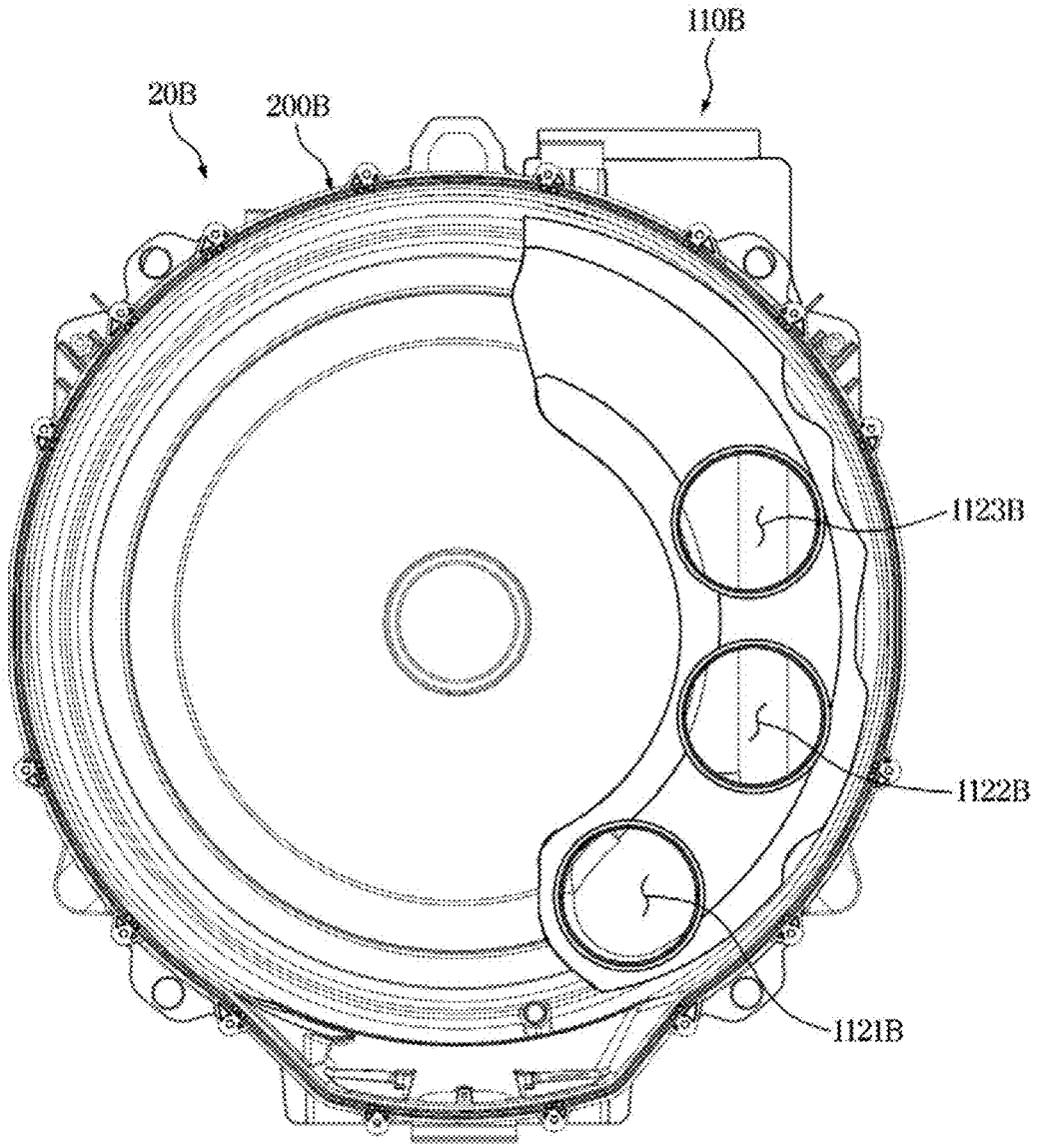
FIG. 15 is a front view illustrating a state in which the exhaust duct is coupled to the tub according to one embodiment.

FIG. 14 is a view illustrating a state in which a tub 20B and an exhaust duct 100B are separated from each other according to one embodiment. FIG. 15 is a front view illustrating a state in which the exhaust duct 100B is coupled to the tub 20B according to one embodiment.

Referring to FIGS. 14 and 15, a clothes treating apparatus 1 according to one embodiment may include the tub 20B in which a second region R2 is open.

The tub 20B may include a first region R1 in which a plurality of reinforcing ribs 201 is formed, and a second region R2 that is open. At this time, the exhaust duct 100B may be mounted on the second region R2. That is, a duct mounting portion 210B may be provided in the second region R2. It is illustrated that the entire second region R2 is open, but only a portion of the second region R2 may be open.

The exhaust duct 100B may be mounted on the duct mounting portion 210B. The exhaust duct 100B mounted on the duct mounting portion 210B may be exposed to the inside of the tub 20B through the open second region R2. In other words, a portion of the exhaust duct 100B may replace a portion of the tub back 200B. Particularly, the duct body 110B may replace a portion of the tub back 200B.

In the clothes treating apparatus according to one embodiment of the present disclosure, because a portion of the tub back 200B is open, the strength of the tub 20B may be reduced. The exhaust duct 100B may be disposed in the second region R2, which is an open region of the tub back 200B. Because the exhaust duct 100B includes a material that is equal to or stronger than the material forming the tub 20B, the strength of the tub 20B may be reinforced. That is, the exhaust duct 100B may reinforce the strength of the second region R2.

The duct body 110B may be coupled to a perimeter of the second region R2. The duct body 110B may be coupled to the perimeter of the second region R2. The duct body 110B may be coupled to the second region R2 through a fastening member.

The duct body 110B may include a duct exhaust port 1120B for discharging air from the tub 20B. The duct exhaust port 1120B may be formed by opening a portion of the duct body 110B. It is illustrated that three duct exhaust ports 1120B are provided, but is not limited thereto.

A sealing member 300B may be disposed between the duct body 110B and the tub back 200B. Because the second region R2 of the tub back 200B is open, air may leak between the tub back 200B and the duct body 110B. To prevent this, the sealing member 300B may be disposed along the perimeter of the second region R2. However, when only a portion of the second region R2 is open, the sealing member 300B may be disposed along the opened portion of the second region R2.

The clothes treating apparatus according to one embodiment may include the tub 20 including the tub back 200 including the first region R1, in which the plurality of reinforcing ribs 201 is formed, and the second region R2, in which the duct mounting portion 210 is formed, the drum 30 configured to be rotatable inside the tub and provided to accommodate laundry, the drying device 70 disposed above the tub and configured to remove moisture from air discharged from the tub and to supply heated air to the tub, the bearing housing 51 coupled to the tub, and the exhaust duct 100 mounted on the tub back and configured to allow air discharged from the drum to flow into the drying device. The exhaust duct 100 includes the duct body 110 including a material having a higher strength than a strength of the tub and provided to, in response to being mounted on the duct mounting portion, be coupled to the bearing housing, and the duct cover 120 coupled to the duct body.

The plurality of reinforcing ribs may include the plurality of cut ribs 202 formed in the second region of the tub back and having a lower protruding height than the plurality of reinforcing ribs.

The tub may include the tub exhaust port 220 formed in the duct mounting portion. The duct body may include the duct exhaust port 1120 formed to correspond to the tub exhaust port to allow the inside of the tub and the exhaust duct to communicate with each other.

The duct body may include the duct inserting portion 1130 protruding toward the tub exhaust port so as to be inserted into the tub exhaust port.

The duct inserting portion may be formed along the circumference of the duct exhaust port.

The duct inserting portion may include the drainage groove 1121*a* formed along the protruding direction of the duct inserting portion to allow moisture remaining on the duct inserting portion to move to the inside of the tub.

The exhaust duct may further include the sealing member 300 disposed between the tub exhaust port and the duct inserting portion to prevent air discharged from the drum from flowing out between the tub exhaust port and the duct inserting portion.

The duct cover may include a material having a higher strength than the strength of the tub.

The duct body may include the body coupling holes 1151 and1152 provided to be coupled to the duct cover. The duct cover may include the cover coupling holes 1251 and 1252 corresponding to the body coupling hole.

The duct body may be coupled to the tub in a state in which the duct body is mounted on the duct mounting portion.

In order that the duct cover and the bearing housing are coupled to each other with the duct body interposed therebetween, the body coupling portion may be formed as the duct body is penetrated.

The bearing housing may include the housing protrusion 5111 protruding toward the duct body for being coupled to the duct body.

The duct body may include the body coupling portion provided to be coupled to the bearing housing. The housing protrusion may be exposed to the outside of the tub so as to be coupled to the body coupling portion in a state in which the bearing housing is inserted into the tub.

The duct cover may include the cover coupling portion 1260 provided to be coupled to the tub. The tub may include the tub protrusion 2060 protruding from the tub back toward the duct cover so as to correspond to the cover coupling portion.

At least a portion of the duct mounting portion may be open to allow the duct body to be exposed to the inside of the tub.

The clothes treating apparatus according to one embodiment may include the tub 20 including the reinforcing ribs 201 and the duct mounting portion 210 in which the cut ribs 202 having a lower protruding height than the reinforcing ribs are formed, the drum 30 configured to be rotatable inside the tub, the bearing housing 51 configured to support the rotating shaft 41 provided to rotate the drum, the bearing housing coupled to the tub, the drying device 70 including the heat pump and configured to dry air discharged from the drum and to supply heated air to the tub, and the exhaust duct 100 configured to allow air discharged from the drum to flow into the drying device. The exhaust duct includes the duct body 110 including a material having a higher strength than a strength of the tub to reinforce the strength of the mounting portion and provided to be mounted on the duct mounting portion, and the duct cover 120 coupled to the duct body.

The duct body may be provided to be coupled to the bearing housing.

The duct cover may be provided to be coupled to the tub.

The clothes treating apparatus according to one embodiment may include the tub 20 including the tub back 200, in which the reinforcing rib 201 is formed in at least a portion thereof and the duct mounting portion 210 is formed in other portion thereof, the drum 30 configured to be rotatable inside the tub, the bearing housing 51 inserted into the tub, the drying device 70 including the heat pump and configured to supply heated air to the tub, and the exhaust duct 100 configured to allow air discharged from the drum to flow into the drying device. The exhaust duct includes the duct body 210 including a material having a higher strength than the strength of the tub to reinforce the strength of the duct mounting portion and provided to, in response to being mounted on the duct mounting portion, be coupled to the bearing housing, and the duct cover 120 coupled to an open side of the duct body.

The duct mounting portion may be open to allow the duct body, which is mounted on the duct mounting portion, to be exposed to the inside of the tub.

As is apparent from the above description, it is possible to improve space efficiency within a clothes treating apparatus.

Further, it is possible to secure a space even when an exhaust duct is coupled.

Further, it is possible to reinforce a strength of a tub.

Additional aspects of the disclosure will be set forth in part in the description which follows and, in part, will be obvious from the description, or may be learned by practice of the disclosure.

While the present disclosure has been particularly described with reference to exemplary embodiments, it should be understood by those of skilled in the art that various changes in form and details may be made without departing from the spirit and scope of the present disclosure.

The invention claimed is:

1. A clothes treating apparatus comprising:

a tub including a tub back forming a rear side of the tub, the tub back having:

a first region including a plurality of reinforcing ribs, and a second region including a duct mounting portion;

a drum inside the tub and configured to accommodate laundry;

a rotatable shaft connected to the drum and configured to rotate the drum;

a bearing housing coupled to the tub and supporting the rotatable shaft;

an exhaust duct on the tub back and including a duct body mounted on the duct mounting portion, coupled to the bearing housing; and a drying device above the tub and configured to remove moisture from air discharged from the tub through the exhaust duct, heat the discharged air from which the moisture was removed, and supply the heated air back to the tub.

2. The clothes treating apparatus of claim 1, wherein the second region of the tub back further includes a plurality of ribs that have a lower protruding height than the plurality of reinforcing ribs.

3. The clothes treating apparatus of claim 2, wherein
the tub back includes a tub exhaust port in the duct mounting portion, and
the duct body includes a duct exhaust port corresponding to the tub exhaust port to allow an inside of the tub and the exhaust duct to communicate with each other so that the air discharged from the tub through the exhaust duct flows through the tub exhaust port, then through the duct exhaust port, and then through the duct body.

4. The clothes treating apparatus of claim 3, wherein the duct body includes a duct inserting portion protruding into tub exhaust port.

5. The clothes treating apparatus of claim 4, wherein the duct inserting portion protrudes from the duct body along a circumference of the duct exhaust port.

6. The clothes treating apparatus of claim 4, wherein the duct inserting portion includes a drainage groove extending along a protruding direction of the duct inserting portion to allow moisture to move to the inside of the tub.

7. The clothes treating apparatus of claim 4, wherein the exhaust duct further includes a sealing member between the tub exhaust port and the duct inserting portion to prevent air discharged from the tub from flowing out between the tub exhaust port and the duct inserting portion.

8. The clothes treating apparatus of claim 1, further comprising:
a duct cover coupled to the duct body.

9. The clothes treating apparatus of claim 1, further comprising:
a duct cover coupled to the duct body,
wherein the duct body includes a body coupling hole, and
the duct cover includes a cover coupling hole corresponding to the body coupling hole.

10. The clothes treating apparatus of claim 9, wherein the duct body is coupled to the tub.

11. The clothes treating apparatus of claim 9, wherein
the duct body includes a body coupling portion on a side of the duct body, and
the duct cover and the bearing housing are coupled with the body coupling portion interposed therebetween.

12. The clothes treating apparatus of claim 1, wherein the bearing housing includes a housing protrusion that protrudes toward, and is coupled to, the duct body.

13. The clothes treating apparatus of claim 12, wherein
the housing protrusion is exposed to an outside of the tub, and
the duct body includes a body coupling portion on a side of the duct body that is coupled to the housing protrusion so as to couple the duct body and the bearing housing.

14. The clothes treating apparatus of claim 12, further comprising:
a duct cover coupled to the duct body and including a cover coupling portion,
wherein the tub includes a tub protrusion protruding from the tub back toward the duct cover and corresponding to the cover coupling portion, and
the cover coupling portion is coupled to the tub protrusion.

15. The clothes treating apparatus of claim 1, wherein at least a portion of the duct mounting portion is open so that the duct body is exposed to an inside of the tub.

16. The clothes treating apparatus of claim 1, wherein the exhaust duct includes aluminum, iron, polyphenylene sulfide (PPS), or a combination thereof.

17. The clothes treating apparatus of claim 1, wherein the bearing housing is formed of aluminum or stainless steel.

* * * * *